US010971847B2

(12) United States Patent
Arlitt et al.

(10) Patent No.: US 10,971,847 B2
(45) Date of Patent: Apr. 6, 2021

(54) DISCONNECT TERMINAL

(71) Applicant: Weidmüller Interface GmbH & Co. KG, Detmold (DE)

(72) Inventors: Uwe Arlitt, Leopoldshöhe (DE); Frank Hackemack, Detmold (DE); Karlo Stjepanovic, Bielefeld (DE); Stefan Fischer, Detmold (DE); Genadij Neumann, Detmold (DE); Peter Stuckmann, Lage (DE); Ralf Schumacher, Lemgo (DE); Michael Lenschen, Detmold (DE); Marco Waldhoff, Sandebeck (DE); Andreas Rutz, Bielefeld (DE); Peter Meyer, Bad Salzuflen (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/713,664

(22) Filed: Dec. 13, 2019

(65) Prior Publication Data

US 2020/0203878 A1 Jun. 25, 2020

(30) Foreign Application Priority Data

Dec. 21, 2018 (DE) ..... 10 2018 133 438.9

(51) Int. Cl.
*H01R 13/44* (2006.01)
*H01R 13/703* (2006.01)

(52) U.S. Cl.
CPC ..... *H01R 13/44* (2013.01); *H01R 13/7032* (2013.01)

(58) Field of Classification Search
CPC ..... H01R 13/44; H01R 9/2633; H01R 9/26; H01R 9/2608; H01R 13/7032; H01H 3/34;

(Continued)

(56) References Cited

U.S. PATENT DOCUMENTS 3,454,836 A * 7/1969 Norden ..... H01R 9/2633 361/632
5,700,986 A * 12/1997 Rurup ..... H01R 9/2683 200/50.32

(Continued)

FOREIGN PATENT DOCUMENTS

DE 4444551 A1 6/1996
DE 19748640 C1 3/1999

(Continued)

OTHER PUBLICATIONS

WAGO, Reihenklemmensysteme, Hauptkatalog, Band 1—Ausgabe 2017/2018. Minden 2017. S. 1, 2, 272.—Firmenschrift.

*Primary Examiner* — Travis S Chambers
(74) *Attorney, Agent, or Firm* — Laubscher & Laubscher, P.C.

(57) ABSTRACT

A disconnect terminal includes an enclosure, a first conductor rail, a second conductor rail, a switching device, and an actuation device. The switching device can be switched by the actuation device from a connecting position, in which the first conductor rail and the second conductor rail are electrically connected by the switching device into a disconnecting position in which the electrical connection of the first conductor rail and the second conductor rail is separated or disconnected, and back. A visible portion of the actuation device aligns with a surface of a portion of an upper side of the enclosure or with a part connected with the enclosure. In the disconnecting position, the visible portion of the actuation device protrudes from a surface of a portion of an upper side of the enclosure or of a part connected with the enclosure in a clearly visible manner. An assembly is provided of at least two aligned disconnect terminals.

15 Claims, 33 Drawing Sheets

(58) Field of Classification Search
CPC ..... H01H 1/36; H01H 3/40; H01H 2071/042; H01H 71/04
USPC ..... 439/188, 94, 532, 709, 716, 832, 439/835–837
See application file for complete search history.

(56) References Cited

U.S. PATENT DOCUMENTS

| | | | | |
|---|---|---|---|---|
| 9,589,755 | B1 | 3/2017 | Singer et al. | |
| 10,388,479 | B2 * | 8/2019 | Zhai | H01H 71/04 |
| 10,547,126 | B2 * | 1/2020 | Riku | H01R 43/00 |
| 2004/0011630 | A1 * | 1/2004 | Pedrinell | H01H 27/00 200/16 R |
| 2016/0056599 | A1 * | 2/2016 | Peach | H01R 9/26 439/508 |
| 2017/0162955 | A1 | 6/2017 | Berg et al. | |

FOREIGN PATENT DOCUMENTS

| | | | |
|---|---|---|---|
| DE | 10118919 | A1 | 10/2002 |
| DE | 60131093 | T2 | 7/2008 |
| DE | 102015121057 | A1 | 6/2017 |
| FR | 2684231 | A1 | 5/1993 |
| WO | 0223675 | A1 | 3/2002 |
| WO | 2014020287 | A1 | 2/2014 |

* cited by examiner

DISCONNECT TERMINAL

This application claims priority of DE 10 2018 133 438.9 filed Dec. 21, 2018. The entire contents of this application is incorporated herein by reference.

BACKGROUND OF THE INVENTION

The present invention relates to a disconnect terminal to an assembly of at least two disconnect terminals. Such disconnect terminals are used in various applications.

Thus, for instance, document DE 197 48 640 C1 describes a measurement disconnect terminal assembly for the operation of current transformers in which power rails are provided with wire connections and contacts. For the connection of current measuring devices or external voltages, a disconnect is needed. This is done by a disconnect piece that interacts with the contacts.

DE 44 44 551 A1 describes a current transformer disconnect terminal with a switch in the form of an angle-adjustable contact disk which ensures by use a contact drag or slide path that during the disconnect or closing of the passage of current through the clamp, the secondary side of a connected current transformer can never be open.

The conventional disconnect terminals as such have proven themselves to be acceptable. It is desirable, however, that this disconnect terminal be further developed such that a simple, quick, and unambiguous identification of the respective switch position of the disconnect terminal, in other words, of a connecting position and of a disconnecting position, is possible. At the same time, a compact structure and a small number of component parts is desired.

SUMMARY OF THE INVENTION

A disconnect terminal according to the invention includes an enclosure or housing, a first conductor rail and a second conductor rail, a switching device and an actuation device. The switching device can be switched by the actuation device from a connecting position, in which the first conductor rail and the second conductor rail are electrically connected by the switching device, into a disconnecting position, in which the electrical connection of the first conductor rail and the second conductor rail is separated, and back. In the connecting position, a visible portion of the actuation device aligns with a surface of a portion of an upper side of the enclosure or of a part connected with the enclosure, and in the disconnecting position, the visible portion of the actuation device protrudes from a surface of a portion of an upper side of the enclosure or of a part connected with the enclosure in a clearly visible manner.

This allows for an unambiguous and quick identification of the switch position of the disconnect terminal.

The portion of the enclosure may be an upper side of a wall of the enclosure, a surface on the upper side of a component of the enclosure or of an inserted part of the enclosure, for instance a bridge holder.

An assembly according to the invention features at least two of the aforementioned disconnect terminals.

An additional assembly according to the invention includes at least two aligned disconnect terminals, wherein each disconnect terminal features an enclosure or housing, a first conductor rail and a second conductor rail, a switching device and an actuation device. The switching device can be switched by the actuation device from a connecting position, in which the first conductor rail and the second conductor rail are electrically connected by the switching device, into a disconnecting position, in which the electrical connection of the first conductor rail and the second conductor rail is separated or disconnected and back. In the connecting position, a visible portion of the actuation device aligns with a surface of a portion of an upper side of the enclosure or of a part connected with the enclosure, and in the disconnecting position, the visible portion of the actuation device protrudes from a surface of a portion of an upper side of the enclosure or of a part connected with the enclosure in a clearly visible manner. Sliding elements, limiter sliders, and/or actuating elements are mutually connected by detachable actuating elements in order to provide synchronous actuation. This allows for simple and fast actuation.

The switching device features a contact plate made of an electrically conductive contact material contact portions, wherein a contact portion forms a drag or slide contact. The contact plate may be produced in a simple manner, for instance as a punched part.

In the connecting position, the contact plate electrically connects the conductor rails via the contact portions in a simple manner. The contact plate is, for instance, a type of blade contact that interacts with contact forks or prongs of the conductor rails.

When in the disconnecting position, the contact plate electrically connects the first conductor rail with a bridge contact via the contact portion forming the drag contact and the contact portions. Thus, when disconnect terminals are aligned, a simple connection of the respective first conductor rails can be achieved in the disconnecting position, which may be advantageous, for instance for the use as current transformer disconnect terminals.

In one embodiment, the switching device and the actuation device feature a joint sliding element which is designed to be linearly movable and which is connected with the contact plate. This results in a compact structure with a small number of component parts.

Moreover, it is advantageous that the sliding element features an actuation portion with the visible portion, since the visible portion does not form an additional component.

In an additional embodiment, the linearly movable sliding element is coupled with a limiter slider via a gear unit such that the limiter slider defines an adjustment track of the linearly movable sliding element in interaction with limit stops of a guide portion in a body of the enclosure. This provides a simple delineation of the adjustment track of the sliding element.

In an alternative embodiment, the switching device features a linearly movable sliding element including the contact plate, wherein the actuation device features a separate actuating element which is coupled with the sliding element by way of interlocking gears or of another form-fitting drive such as a rack and pinion coupling. This leads to a simple manual actuation requiring a lower exertion of force.

The actuating element of the actuation device features an actuation portion including the visible portion wherein the actuating element is arranged pivotably around an axis. This allows for a compact structure.

In another embodiment, the sliding element includes a guide portion in the form of a bar with a front face including the visible portion. This allows for an additional display option of the respective switch position of the disconnect terminal.

In a further alternative embodiment, the switching device has a linearly movable sliding element including the contact plate and the actuation device has a separate actuation lever which features the visible portion and which is coupled with the sliding element via a lever gear mechanism. The lever gear mechanism allows for transmission of power from manual actuation to the sliding element. Furthermore, preset end positions can be easily obtained.

In a further embodiment, the lever gear mechanism includes the actuation lever and a transmission lever, the transmission lever being coupled with the sliding element. This leads to a simple structure with a minimal space requirement.

In yet another alternative embodiment, the switching device has a switch lever with an actuation end including the visible portion and is formed by the contact plate which has an elongated, blade-like form. This leads to a simple and space-saving embodiment.

A further embodiment provides the switch lever of the actuation device being solidly connected with the elongated blade-like contact plate of the switching device and being pivotable together with the contact plate around a joint fixed switch lever axis. This structure is advantageous since only a small number of component parts is needed. Moreover, only a small manual exertion of force is needed. Alternatively, a tool or actuation device may be used as well.

In a further embodiment, the switch lever in the connecting position abuts an enclosure stop with its actuation end wherein the visible portion aligns with a surface of the enclosure stop. In the disconnecting position, the switch lever with the contact plate is pivoted around the fixed pivoting axis and abuts a bridge holder by way of a limit stop, wherein the visible portion of the actuation end of the switch lever protrudes from the surface of the bridge holder as a portion or a component of the enclosure. In this manner, simple identification of the switch status or position of the disconnect terminal can be achieved.

In one embodiment of an assembly, at least two disconnect terminals jointly have a bridge holder with bridge contacts that are electrically connected with each other. Thus, a range of application of the disconnect terminal is advantageously extended.

BRIEF DESCRIPTION OF THE FIGURES

In the following specification, the invention is described in further detail based on exemplary embodiments with reference to the accompanying drawings in which.

DETAILED DESCRIPTION

The words "upper", "lower", "left", and "right" relate to the respective assembly of the components in the figures.

Figure 1:
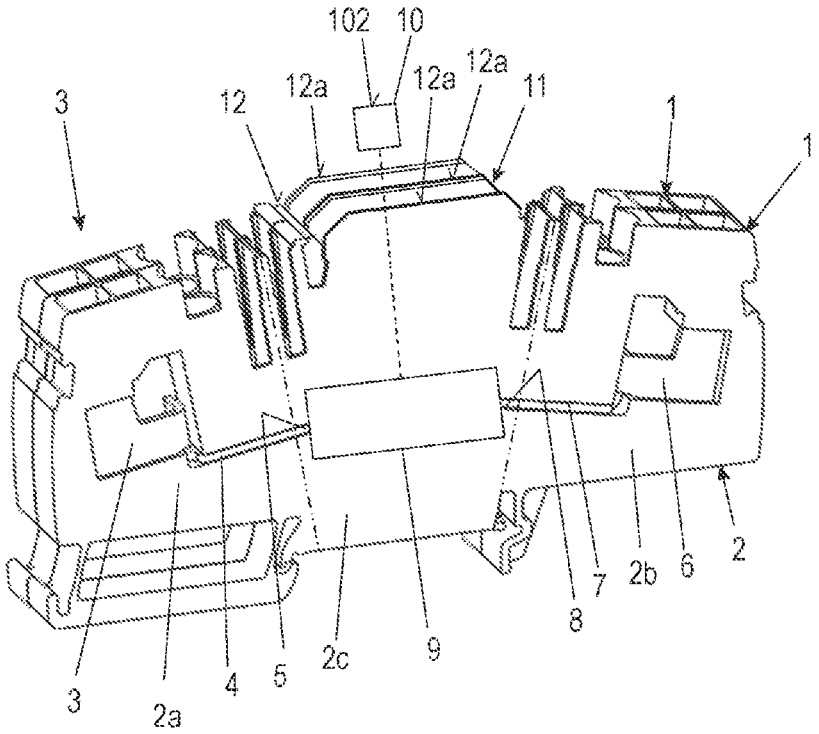
FIG. 1 is a schematic perspective view of a disconnect terminal according to the invention with a block representation of a switching device and of an actuation device.

FIG. 1 is a perspective view of an embodiment of a disconnect terminal 1 according to the invention with a block representation of a switching device 9 and an actuation device 10.

The disconnect terminal 1 includes an enclosure or housing 2 with a first connection portion 2*a*, a second connection portion 2*b*, and a disconnect portion 2*c* centrally arranged between them.

In the first connection portion 2*a*, a first terminal portion 3 is arranged for connecting an electrically conductive conduit, not shown. The first terminal portion 3 is connected with a first conductor rail 4 which extends with one connecting portion 5 into the disconnect portion 2*c*.

Similarly, in the second connection portion 2*b*, in a mirror-inversion of the first connection portion 2*a*, a second terminal portion 6 is arranged for connecting an electrically conductive conduit, not shown. The second terminal portion 6 is connected with a second conductor 7 which extends with one connecting portion 8 into the disconnect portion 2*c*.

The connecting portion 5 of the first conductor rail 4 and the connecting portion 8 of the second conductor rail 7 have an operative connection with a switching device 9. The switching device 9 features two positions. In a connecting position, the switching device 9 electrically connects the two connecting portions 5 and 8, and therefore the first conductor rail 4 and the second conductor rail 7, such that the first terminal portion 3 is electrically connected with the second terminal portion 6.

In a disconnecting position of the switching device 9, the two connecting portions 5 and 8 are separate and insulated from each other, in other words, the electrical connection between the two connecting portions 5 and 8, and therefore of the conductor rails 4 and 2, is separated or disconnected.

The switching device 9 is coupled with an actuation device 10. The actuation device 10 is designed for switching the switching device 9 from the connecting position into the disconnecting position, and back. The actuation device 10 is actuated manually and/or by a suitable tool. The respective position, in other words, the connecting position and the disconnecting position of the switching device 9, is visually displayed by the actuation device 10. This is executed such that in the connecting position, a visible portion 102 of the actuation device 10 aligns with a surface 12, 12*a* of a portion of an upper side of the enclosure 2 or with a part connected with the enclosure 2, and that in the disconnecting position, the visible portion 102 of the actuation device 10 protrudes from the surface 12, 12*a* of a portion of the upper side of the enclosure 2 or of a part connected with the enclosure 2 in a clearly visible manner.

In the disconnect portion 2*c*, the switching device 9 and the actuation device 10 coupled with it are arranged as a disconnect unit 11 shown in FIG. 1 by double-dotted dashed lines.

In the example illustrated in FIG. 1, two disconnect terminals 1 are arranged side-by-side although any number of disconnect terminals may be provided. In certain applications of these disconnect terminals 1, it is necessary that in the disconnecting position of the disconnect terminals 1, the first terminal portions 3 are short-circuited, in other words, electrically connected with each other. For these purposes, in the disconnecting position, the switching device 9 may connect the first terminal portions 3 with each other by means of a so-called short-circuit bridge. This will be described below in detail.

Figure 2A:
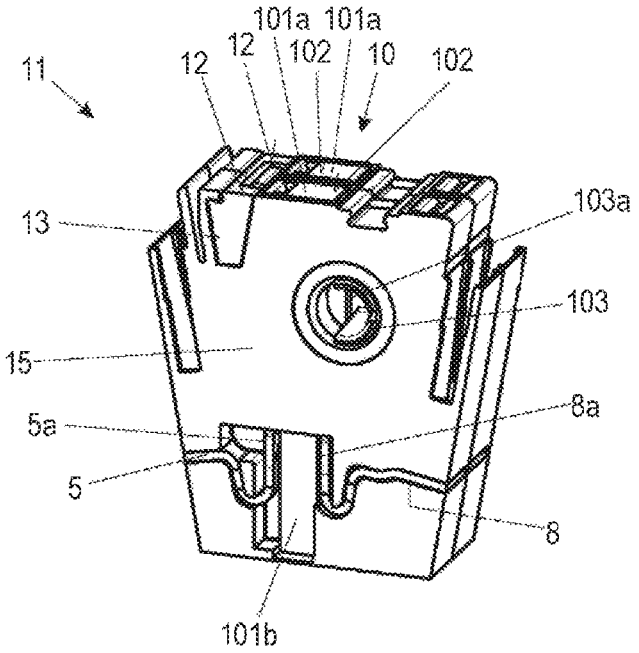
FIGS. 2*a*-2*c* are perspective views of a first embodiment of a disconnect unit of the disconnect terminal according to FIG. 1, in various positions, respectively.
Figure 2B:
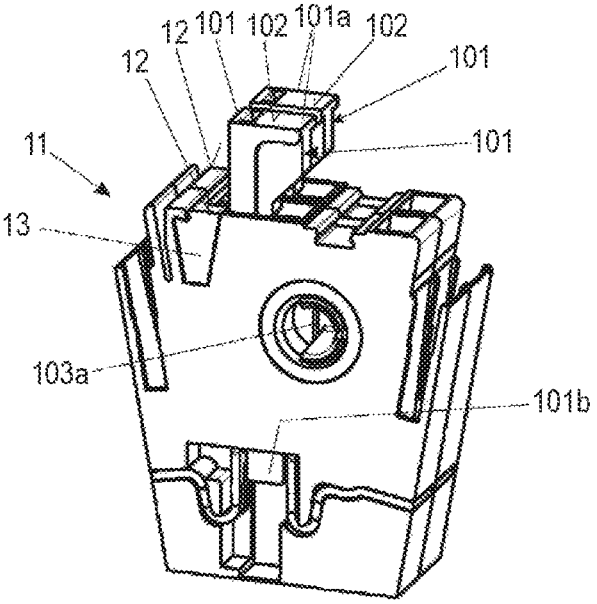
Figure 2C:
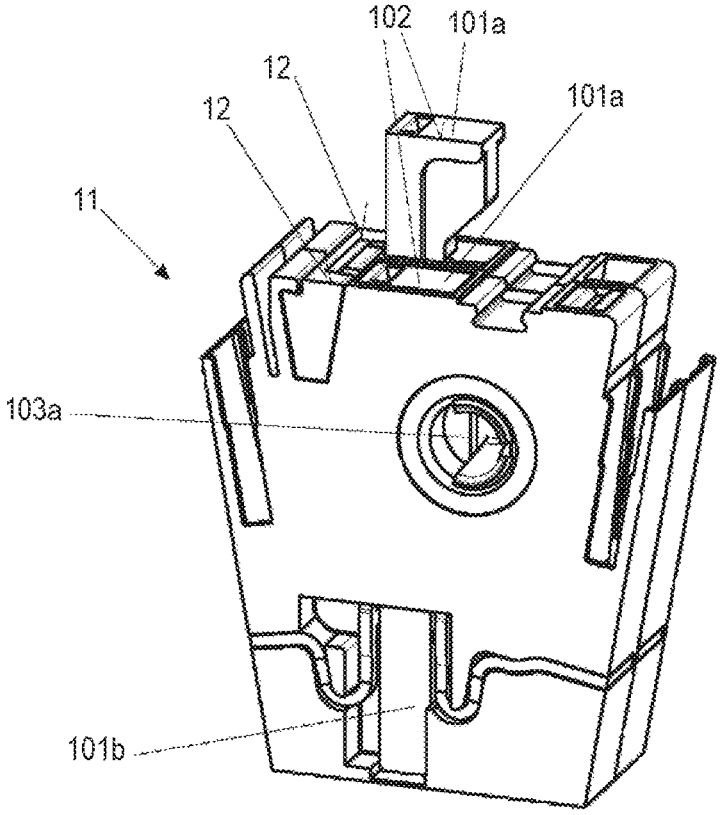
Figure 3A:
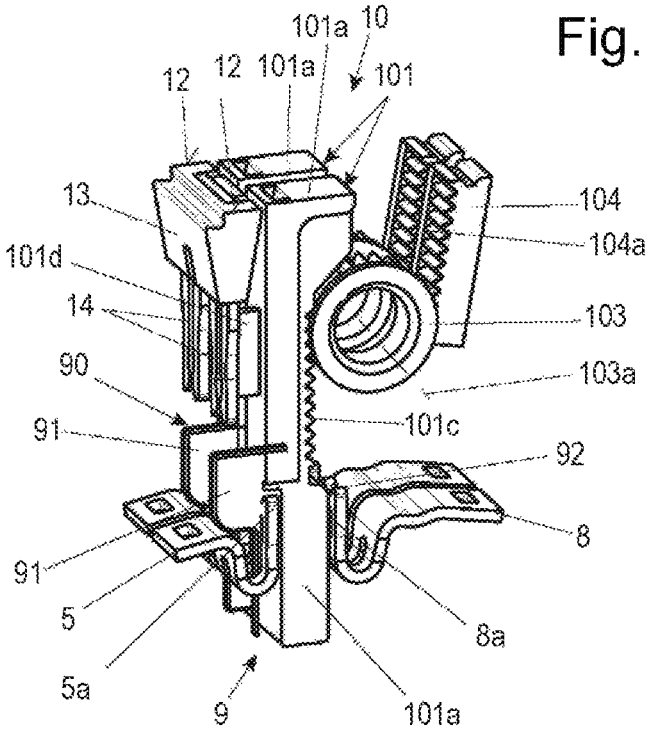
FIGS. 3*a*-3*c* are perspective views of the actuation device and the switching device of the first exemplary embodiment according to FIGS. 2*a*-2*c*, respectively, in various positions without an enclosure.
Figure 3B:
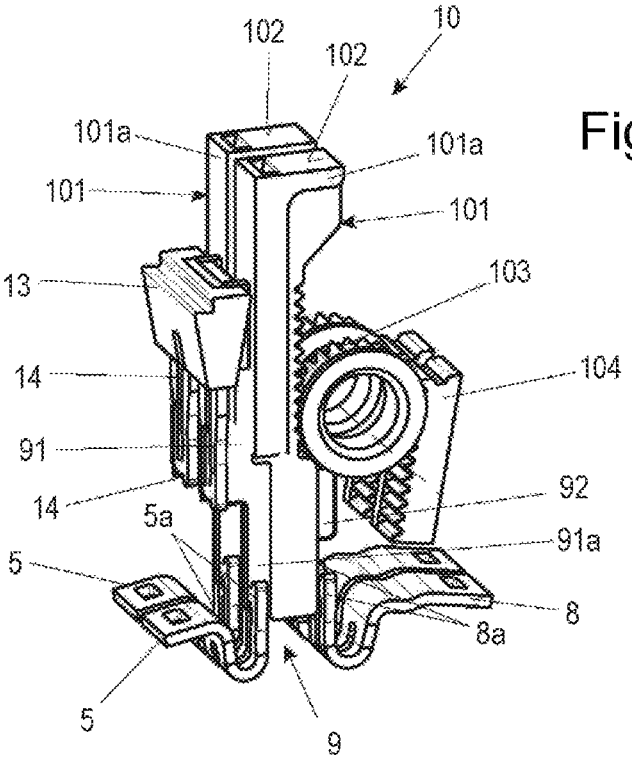
Figure 3C:
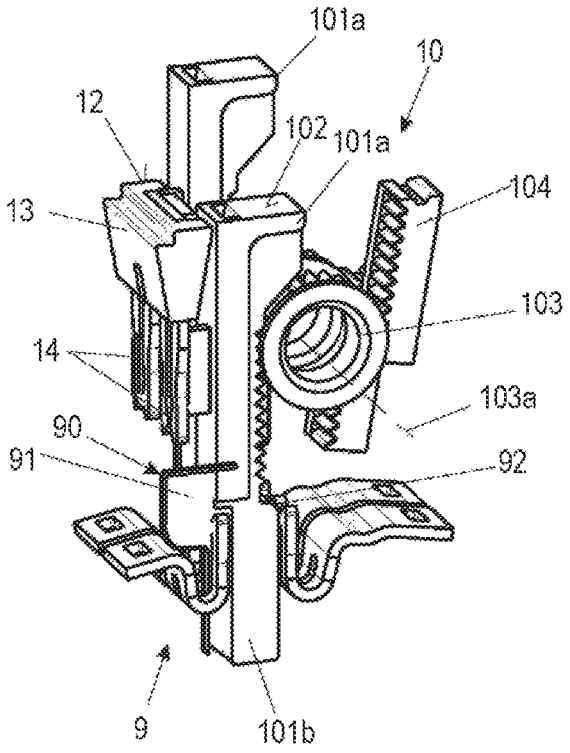
Figure 4A:
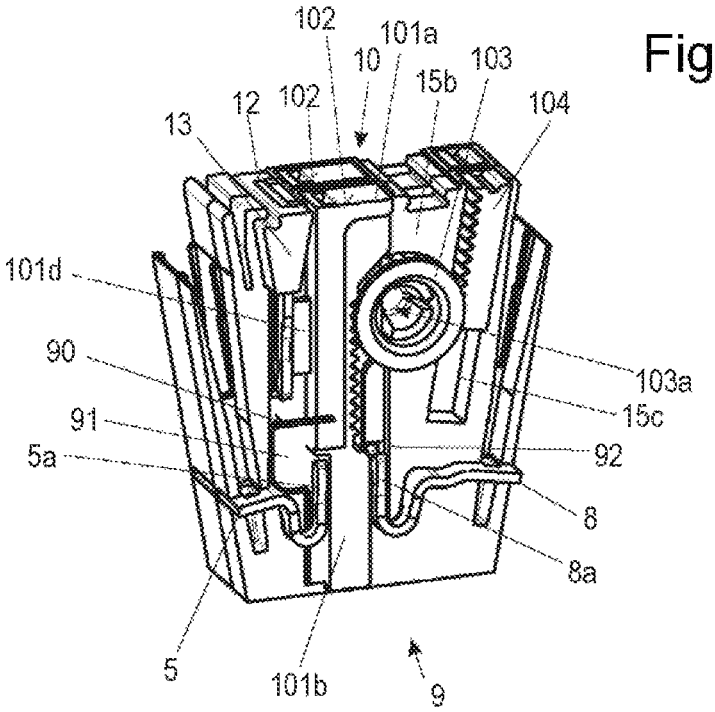
FIGS. 4*a*-4*c* are perspective views of the actuation device and the switching device according to FIGS. 3*a*-3*c*, respectively, in various positions with an enclosure.
Figure 4B:
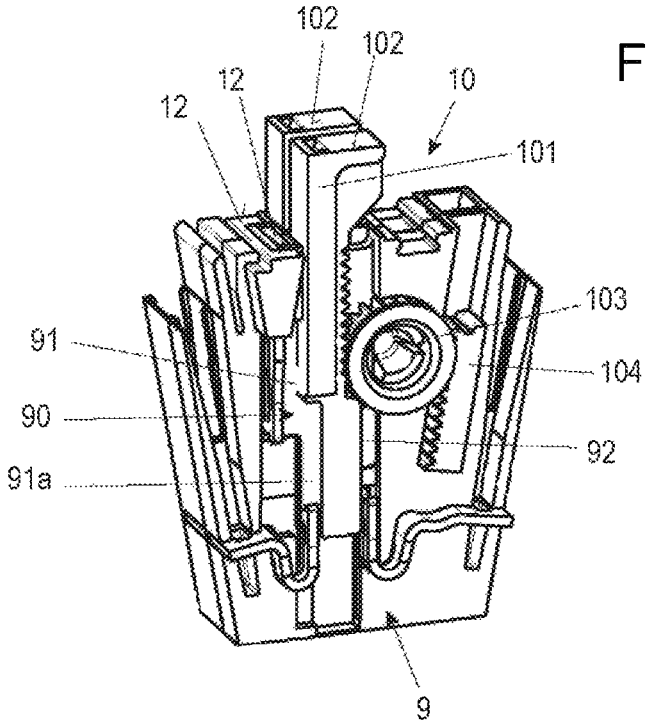
Figure 4C:
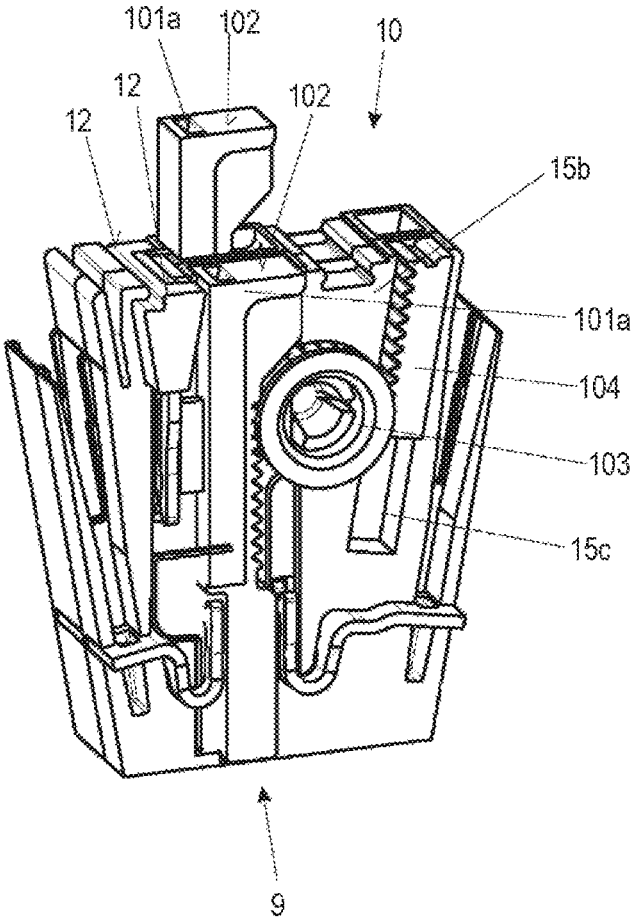
Figure 5:
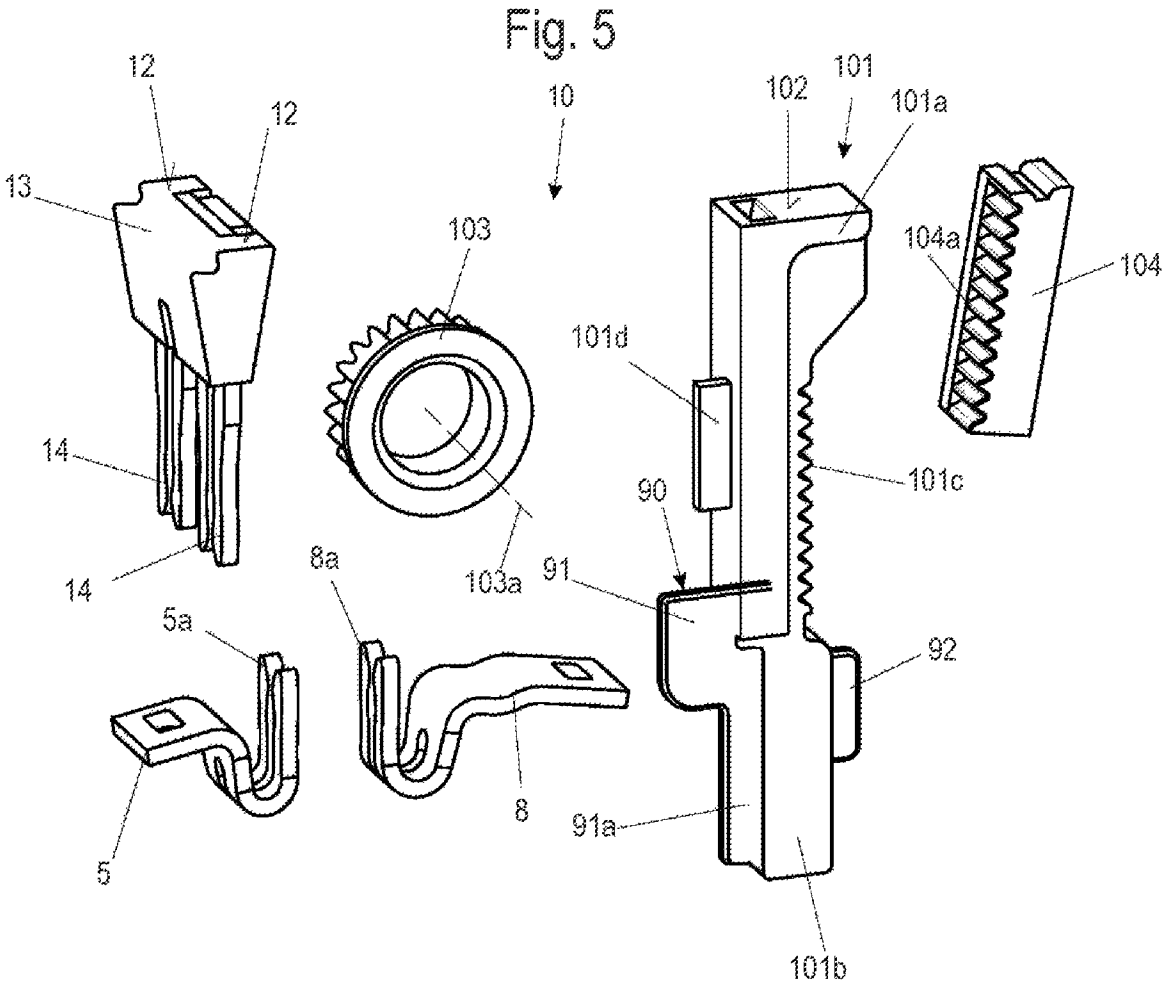
FIG. 5 is an exploded perspective view of individual components of the actuation device and the switching device of the first embodiment according to FIGS. 2*a*-2*c;*

FIGS. 2*a*-2*c* are perspective views of a first embodiment of the disconnect unit 11 of the disconnect terminal 1 according to FIG. 1 in various positions. FIGS. 3*a*-3*c* are perspective views of the actuation device 10 and the switching device 9 of the first embodiment according to FIGS. 2*a*-2*c* in various positions without an enclosure. FIGS. 4*a*-4*c* are perspective views of the actuation device 10 and the switching device 9 according to FIGS. 3*a*-3*c* in various positions with an enclosure. FIG. 5 is an exploded perspective view of individual components of the actuation device 10 and the switching device 9 of the first embodiment according to FIGS. 2*a*-2*c*, FIG. 2*a*, FIG. 3*a*, and FIG. 4*a*, respectively, show the connecting position of the disconnect units 11. The disconnecting position of the disconnect units 11 is shown in FIG. 2*h*, FIG. 3*h*, and FIG. 4*b*, respectively. FIG. 2*c*, FIGS. 3*c*, and 4*c* each show a disconnect unit 11 of the two disconnect terminals 1 in a disconnecting position, and they each show a disconnect unit 11 in a connecting position. It can be clearly identified which disconnect terminal is set to a disconnecting position, and which is set to a connecting position.

In the first embodiment, the switching device 9 and the actuation device 10 include a joint sliding element 101. The sliding element 101 is linearly movable in the disconnect unit 11 in a manner that is not further illustrated, in other words, it is borne longitudinally, and in this case arranged perpendicularly to an imaginary longitudinal axis of the connecting portions 5, 8 of the conductor rails 4, 7. The sliding element 101 is rod-shaped, formed to have a substantially rectangular cross section.

The sliding element 101 includes an actuation portion 101*a* at an upper end, a switching end 101*b* at a lower end, interlocking gears 101*c* in the form of a toothed rack portion on a longitudinal side, and a guide portion 101*d* on a longitudinal side facing the longitudinal side with the interlocking gears 101*c*.

The guide portion 101*d* is a type of longitudinal bar, which forms a locking system of the sliding element 101 in the bridge holder 13 for stopping the short-circuit bridge thus formed in the disconnecting position with the contact portion 91 of the contact plate 90 in the bridge contact portions 14. The guide portion 101*d* may also extend further upward, thus engaging the guide surface of the bridge holder 13. This is not shown, but is evident from FIGS. 3*a* through 3*c*, 4*a* through 4*c*, and 5.

In the disconnecting position, the narrow front face of the guide portion 101*d* pointing upward to the actuation portion 101*a* of the sliding element 101 may form an additional position indicator of the disconnect terminal 1 with the surface 12 of the bridge contact holder 13. Thus, this front face of the guide portion 101*d* can align in the disconnecting position with the surface 12 of the bridge contact holder 13 and be colored, for instance, as a colored visible portion, thereby indicating the disconnecting position. In the other case in which the guide portion 101*d* extends further upward, the connecting position may be indicated by the alignment of the front face with the surface 12 of the bridge contact holder 13. In the disconnecting position, the upper extended portion of the guide portion 101*d* will then protrude from the surface 12 of the bridge contact holder 13, thus indicating the disconnecting position.

The switching device 9 features a contact plate 90 formed as a blade contact with three contact portions 91, 91*a*, and 92. These three contact portions 91, 91*a*, and 92 are electrically connected with each other and attached to the sliding element 101 in the area of the switching end 101*a* with two contact portions 91 and 91*a* being arranged on a longitudinal side of the sliding element 101 that points to the first connecting portion 5, and the contact portion 92 being arranged on the opposite longitudinal side of the sliding element 101 that points to the second connecting portion 8.

The contact portions 91 and 91*a* interact with a contact fork or prong 5*a* of the connecting portions 5 of the first conductor rail 4. An additional contact fork 8*a* at the end of the connecting portion 8 of the second conductor rail 8 faces the contact fork 5*a* and interacts with the contact portion 92 of the contact plate 90.

A bridge contact fork 14 is arranged above the contact fork 5*a*. The bridge contact fork 14 is attached to a bridge holder 13 by an additional, parallel, bridge contact fork 14. The bridge contact forks 14 are electrically connected with each other.

The sliding element 101 is coupled with a limiter slider 104 via a gear unit. The gear unit features the interlocking gears 101*c* (toothed rack) of the sliding element 101, a rotatable transmission element 103 with corresponding interlocking gears, and additional interlocking gears 104*a* (toothed rack) of the limiter sliders 104.

The sliding element 101 engages the transmission element 103 via its interlocking gears 101*c*. The transmission element 103 is formed as a spur gear wheel, rotatable around an axis 103*a* in lateral walls 15 of the disconnect portion 2*c* and borne in a body member 15*b*.

Furthermore, the transmission element 103 engages the limiter sliders 104 with its interlocking gears 104*a*. The limiter slider 104 is arranged opposite the sliding element 101 in a guide portion 15*c* of the disconnect portion 2*c* in a longitudinally slidable manner. The guide portion 15*c* furthermore forms limit stops for the longitudinal slidability of the limiter sliders 104.

By means of the actuation portion 101*a*, the sliding element 101 can be switched from the connecting position to the disconnecting position and back.

In the connecting position, the contact plate 90 is electrically connected with the contact fork 5*a* of the first conductor rail 4. At the same time, the contact portion 92 of the contact plate 90 is electrically connected with the contact fork 8*a* of the second conductor rail 7, thus forming an electrical connection between the contact forks 5*a* and 8*a*.

Moreover, the guide portion 101*d* is slidably guided in the bridge contact fork 14 and in the bridge contact holder 13. The guide portion 101*d* is not electrically conductive.

In the connecting position, a visible portion 102 of the actuation portion 101*a* of the sliding element 101 aligns with a surface 12 of a portion of the enclosure 2. The portion of the enclosure 2 may be the upper side of the wall 15 of the enclosure 2. Here too, a surface 12 is arranged on the upper side of the bridge holder 13. The bridge holder 13 is a component of the enclosure 2 and inserted into it.

By pressure actuation of the limiter slider 104, the sliding element 101 is longitudinally moved upward via the transmission element 103 into the disconnecting position. The longitudinal movement of the limiter slider 104 is defined in the guide portion 15*c* by a limit stop for the disconnecting position, and by a limit stop of the slider element 101 for the connecting position. In the disconnecting position, the contact forks 5*a* and 8*a* are separated, since the contact portion 92 of the contact plate 90 is pulled out upward from the contact fork 8*a*. The extended contact portion 91*a*, however, remains in contact with the contact fork 5*a*, forming a so-called drag or sliding contact.

In the disconnecting position, the upper contact portion 91 of the contact plate 90 has an electro-conductive contact with the bridge contact fork 14. The bridge contact fork 14 and the contact fork 5*a* of the first conductor rail 5 are now electrically connected by the extended contact portion 91*a* that forms a drag contact. The guide portion 101*d* is guided in the bridge contact holder 13 in a longitudinal groove.

In the disconnecting position, the actuation portion 101*a* and the visible portion 102 of the sliding element 101 visibly protrudes from the surface 12 of the disconnect portion 2*c*.

In the illustrated embodiment with the two disconnect portions 2*c* of the two disconnect terminals 1 in the disconnecting position of the two disconnect terminals 1, both first conductor rails 5 are electrically connected via the bridge contact forks 14.

Figure 6A:
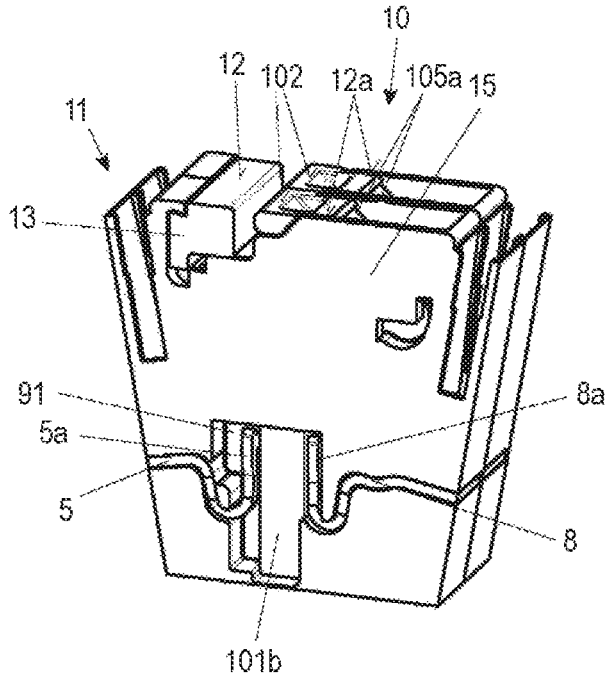
FIGS. 6*a*-6*c* are perspective views of a second embodiment of a disconnect unit of the disconnect terminal according to FIG. 1, in various positions, respectively.
Figure 6B:
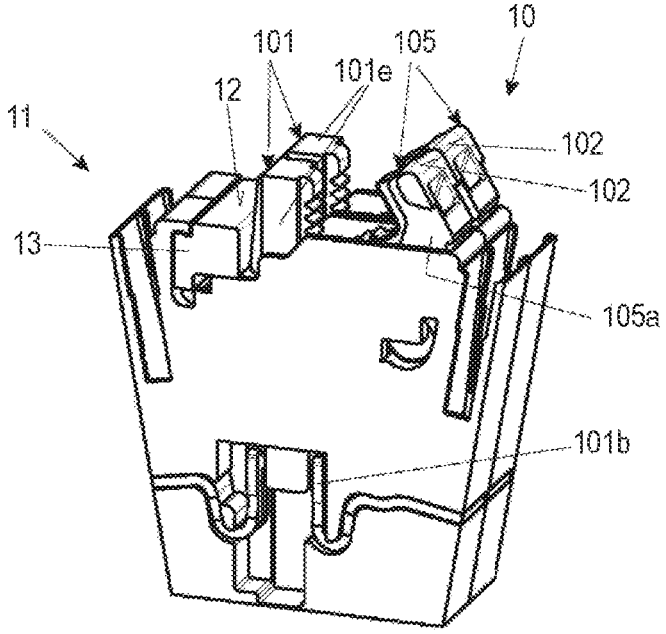
Figure 6C:
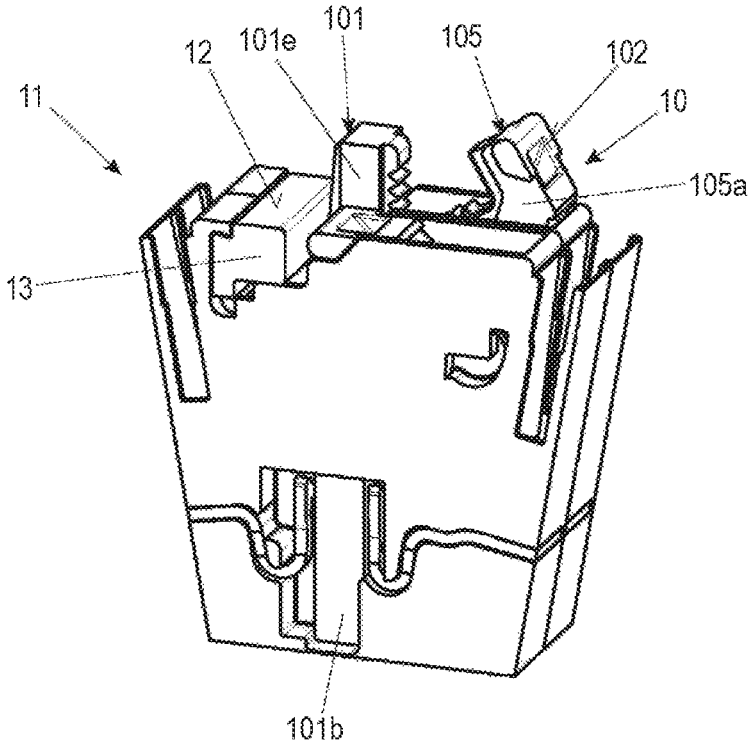
Figure 7A:
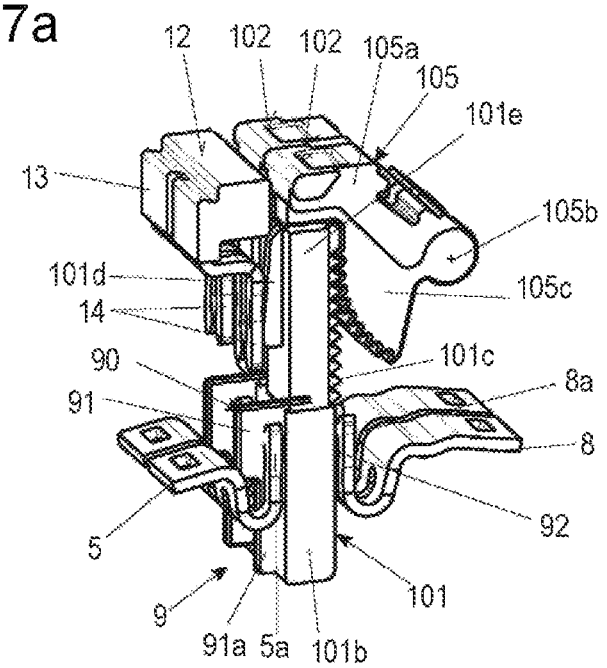
FIGS. 7*a*-7*c* are perspective views of the actuation device and the switching device of the second embodiment according to FIGS. 6*a*-6*c*, respectively, in various positions without an enclosure.
Figure 7B:
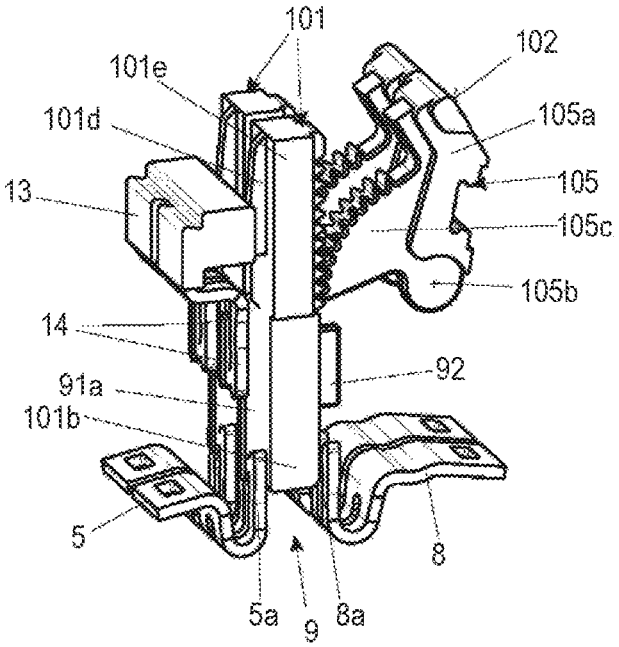
Figure 7C:
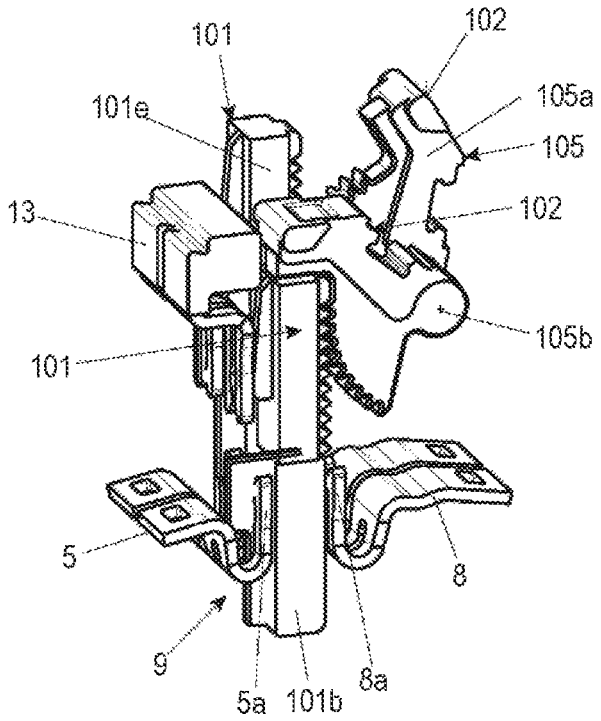
Figure 8A:
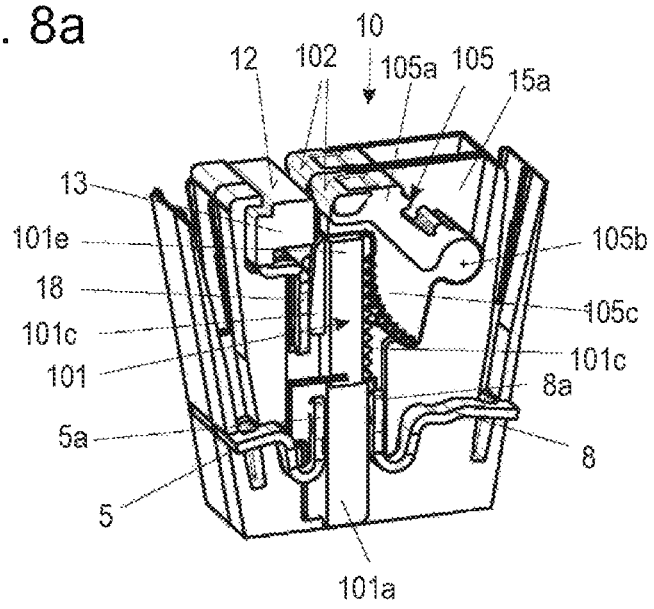
FIGS. 8*a*-8*c* are schematic perspective views of the actuation device and the switching device of the second embodiment according to FIGS. 7*a*-7*c*, respectively, in various positions with an enclosure.
Figure 8B:
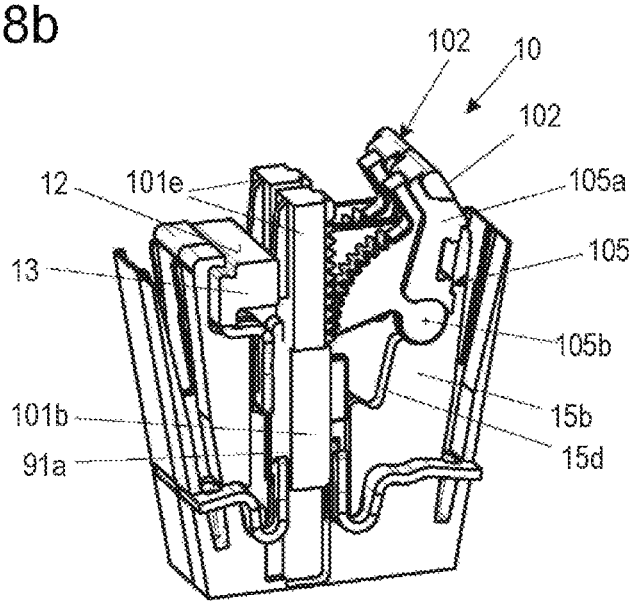
Figure 8C:
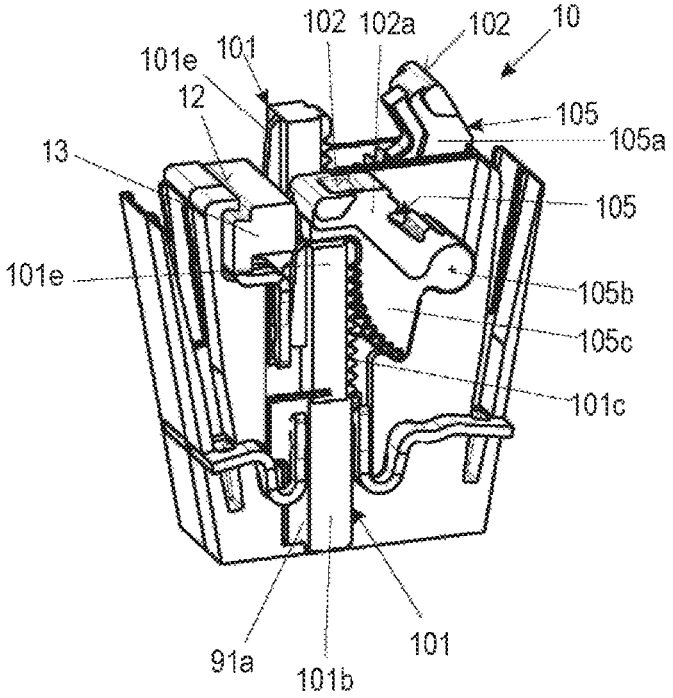
Figure 9:
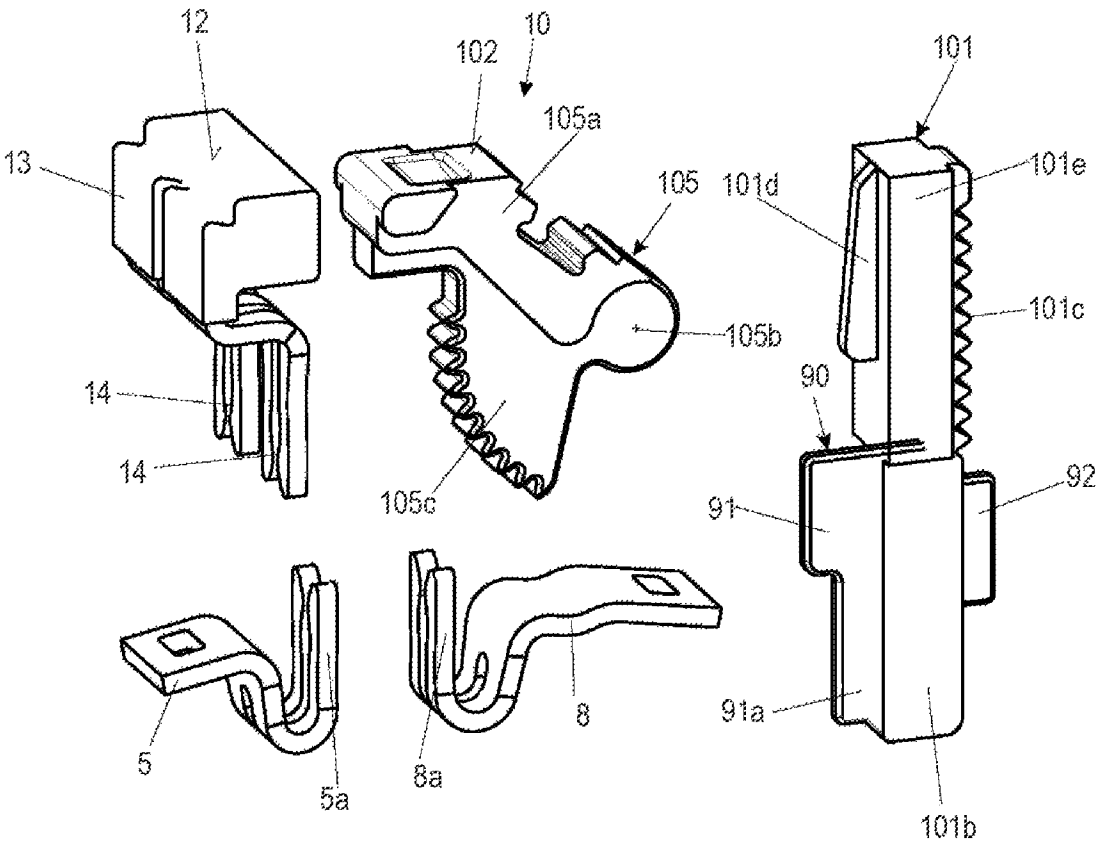
FIG. 9 is an exploded perspective view of individual components of the actuation device and the switching device of the second embodiment according to FIGS. 6*a*-6*c;*

FIGS. 6*a*-6*c* are perspective views of a second embodiment of the disconnect unit 11 of the disconnect terminal 1 according to FIG. 1, in various positions. FIGS. 7*a*-7*c* are perspective views of the actuation device 10 and the switching device 9 of the second exemplary embodiment according to FIGS. 6*a*-6*c* in various positions without an enclosure. FIGS. 8*a*-8*c* are perspective views of the actuation device 10 and the switching device 9 according to FIGS. 7*a*-7*c* in various positions with an enclosure. FIG. 9 is an exploded perspective view of individual components of the actuation device 10 and the switching device 9 of the second embodiment according to FIGS. 6*a*-6*c*.

FIG. 6*a*, FIG. 7*a*, and FIG. 8*a* show the connecting position of the disconnect units 11. The disconnecting position of the disconnect units 11 is respectively shown in FIG. 6*b*, FIG. 7*b*, and FIG. 8*b*. FIG. 6*c*, FIG. 7*c*, and FIG. 8*c* each show a disconnect unit 11 of the two disconnect terminals 1 in a disconnecting position, and they each show a disconnect unit 11 in a connecting position. It clearly shown which disconnect terminal is set to a disconnecting position, and which is set to a connecting position.

In the second embodiment, the switching device 9 and the actuation device 10 are separated. The switching device 9 includes the linearly movable sliding element 101 with the switching end 101*b*, with the interlocking rack gears 101*c*, the guide portion 101*d*, and the contact plate 90 with the contact portions 91, 91*a*, and 92. Furthermore, the disconnect unit 11 features the bridge contact forks 14 with the bridge holder 13.

Contrary to the first embodiment, the sliding element 101 of the second embodiment features an end portion 101*e* without an actuation portion and without a visible portion.

The actuation device 10 includes a separate actuating element 105 coupled with the sliding element 101 by interlocking gears. The actuating element 105 features an actuation portion 105*a* with a visible portion 102 and a gear segment 105*c* in the form of a quarter circle. The actuating element 105 is pivotably arranged around an axis 105*b*. A pivot angle of the actuating element 105 is defined by limit stops in the body member 15*b* such as system portion 15*d*.

The gear segment 105*c* engages the rack-shaped interlocking gears 104*c* of the sliding element 101.

In the connecting position, the visible portion 102 of the actuation portion 105*a* of the actuating element 105 aligns with a surface 12 of a portion of the enclosure 2. The portion of the enclosure 2 may be the upper side of the wall 15 of the enclosure 2. Furthermore, the portion of the enclosure 2 is also the upper side of the bridge holder 13 on which the surface 12 is arranged. The actuation portion 105*a* is supported with the lower side of the visible portion 102 on the front face of the end portion 101*e* of the sliding element 101.

The connecting position of the sliding element 101 with the contact plate 90 is as described for the first embodiment.

It is swiveled by a pivoting actuation of the actuation portion 105*a* of the actuating element 105 (in a clockwise direction in the embodiment shown) around axis 105*b*. The sliding element 101 engaged by the gear segment 105*c* is linearly shifted upward into the disconnecting position, wherein the electro-conductive connection of the contact forks 5*a* and 8*a* described above with respect to the first embodiment is separated or disconnected.

In the disconnecting position, the actuation portion 105*a* with the visible portion 102 of the actuating element 105 as well as the upper end portion 101*e* of the sliding element 101 visibly protrude from the surface 12 of a portion of the enclosure 2 and also from the surface 12 of the bridge holder 13.

Figure 10A:
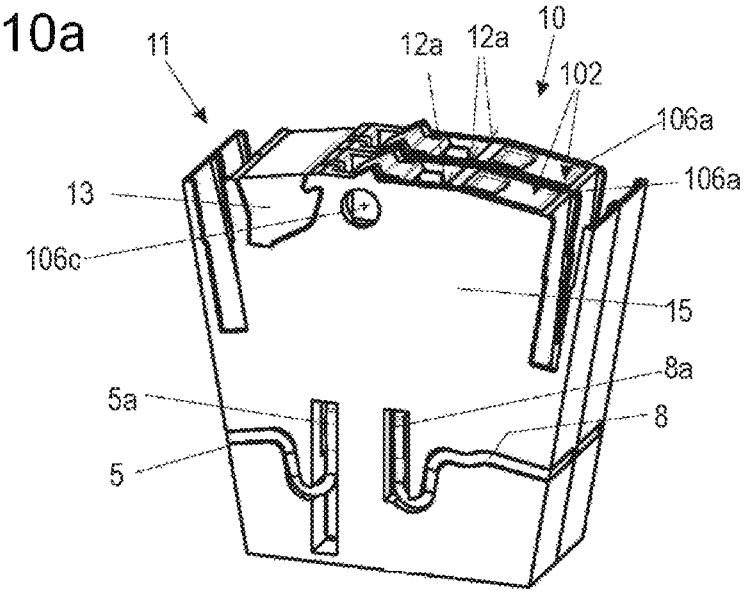
FIGS. 10*a*-10*c* are perspective views of a third embodiment of a disconnect unit of the disconnect terminal according to FIG. 1, in various positions, respectively.
Figure 10B:
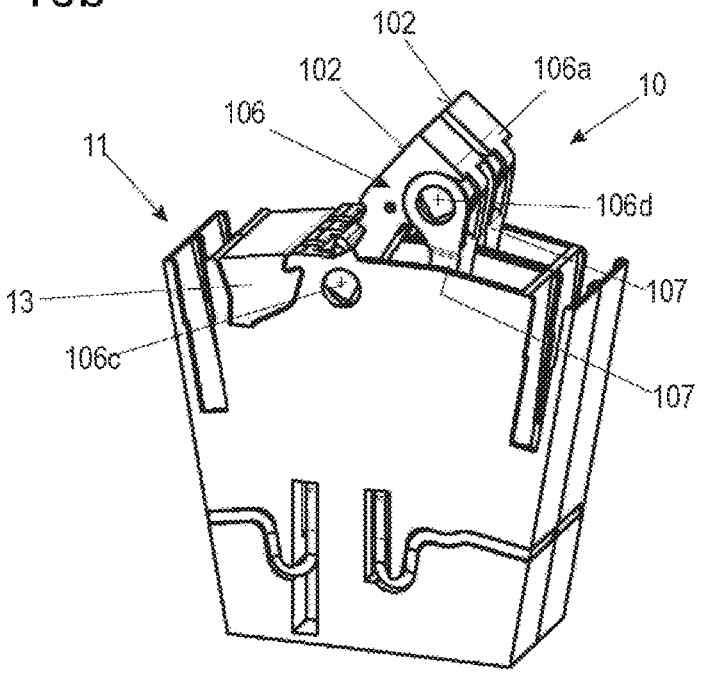
Figure 10C:
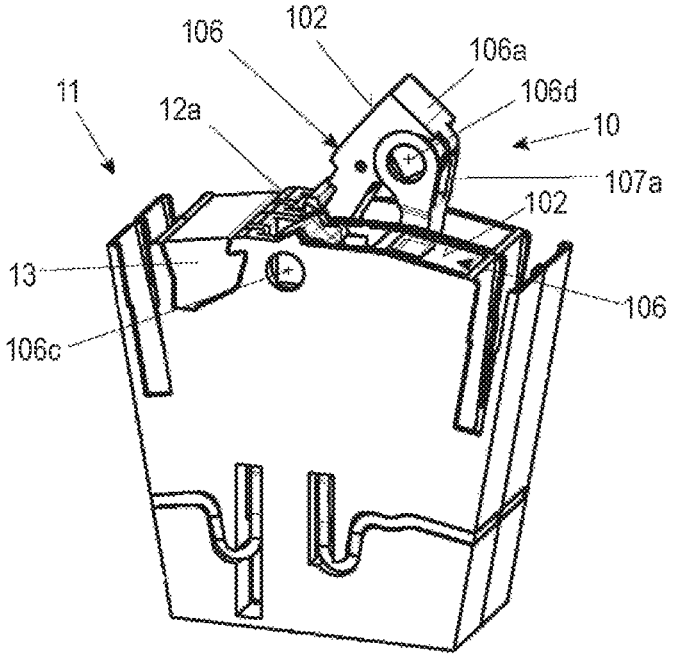
Figure 11A:
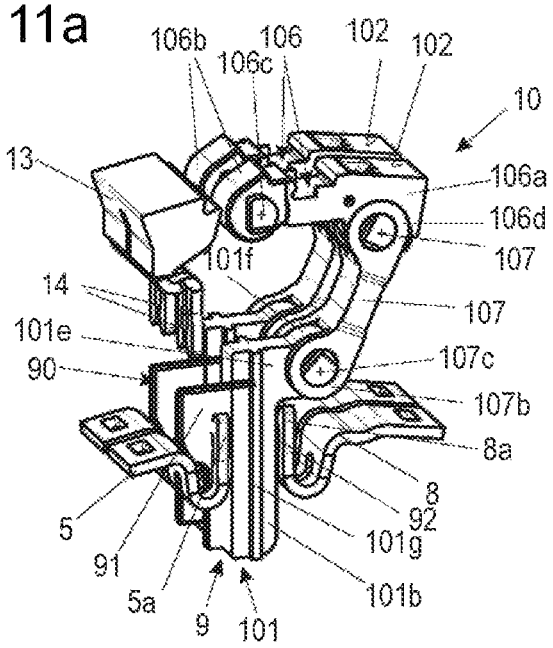
FIGS. 11*a*-11*c* are perspective views of the actuation device and the switching device of the third embodiment according to FIGS. 10*a*-10*c*, respectively, in various positions without an enclosure.
Figure 11B:
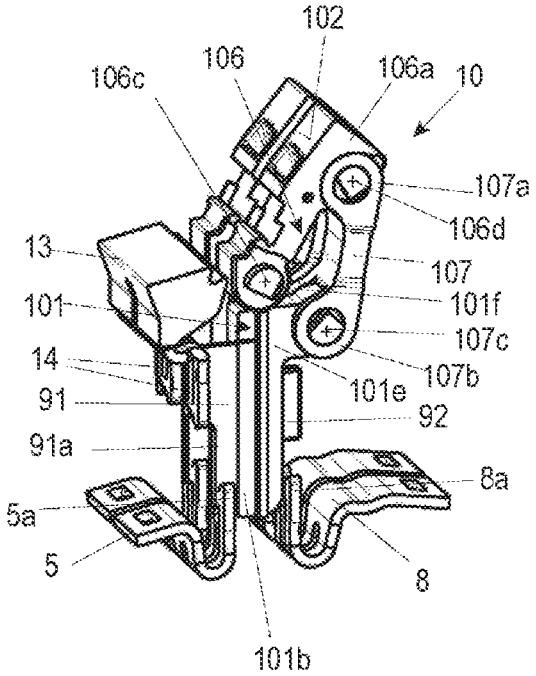
Figure 11C:
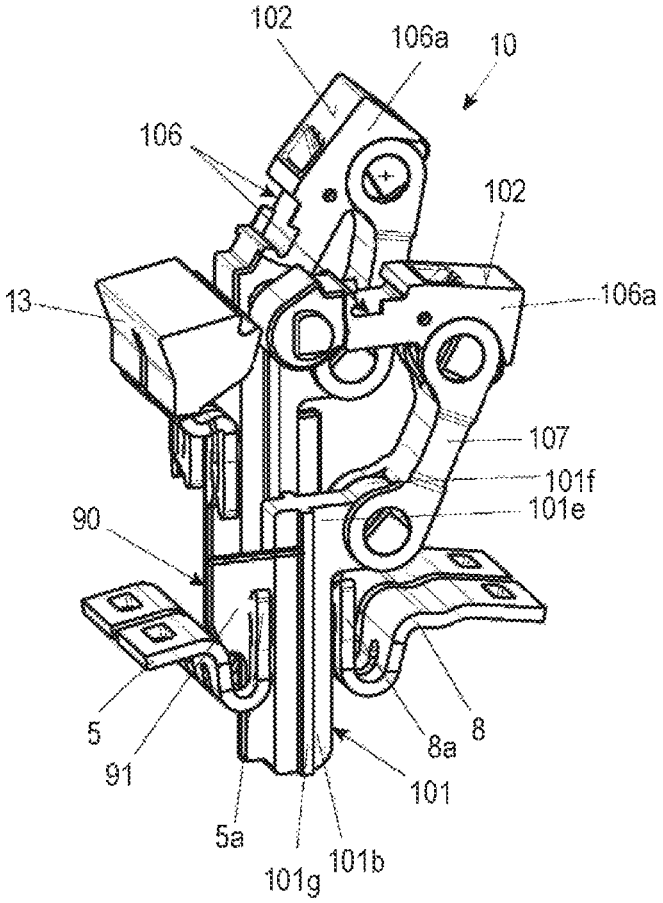
Figure 12A:
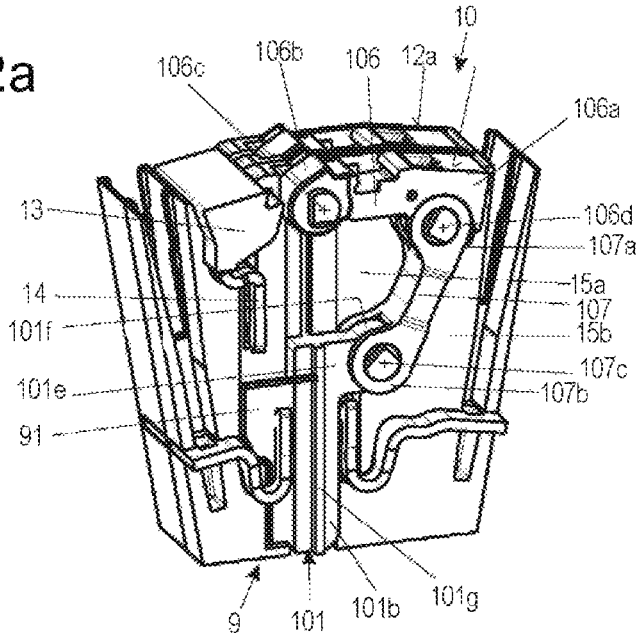
FIGS. 12*a*-12*c* are perspective views of the actuation device and the switching device of the third embodiment according to FIGS. 11*a*-11*c*, respectively, in various positions with an enclosure.
Figure 12B:
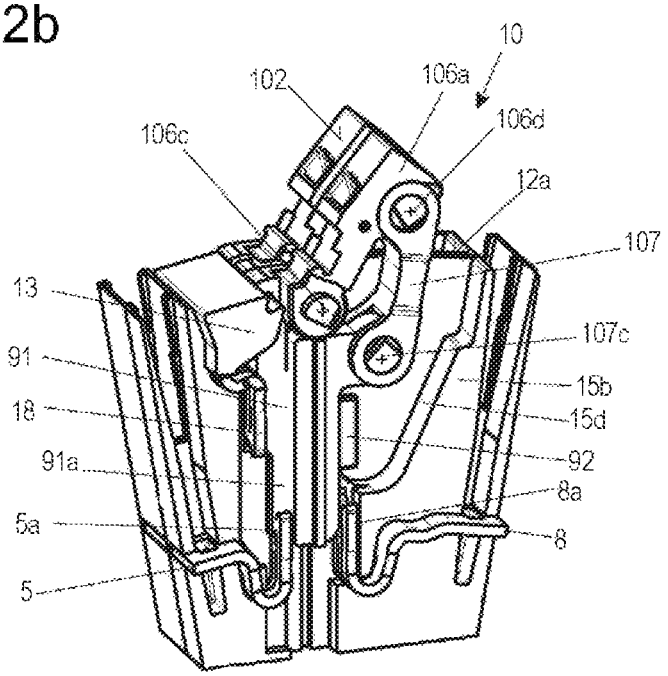
Figure 12C:
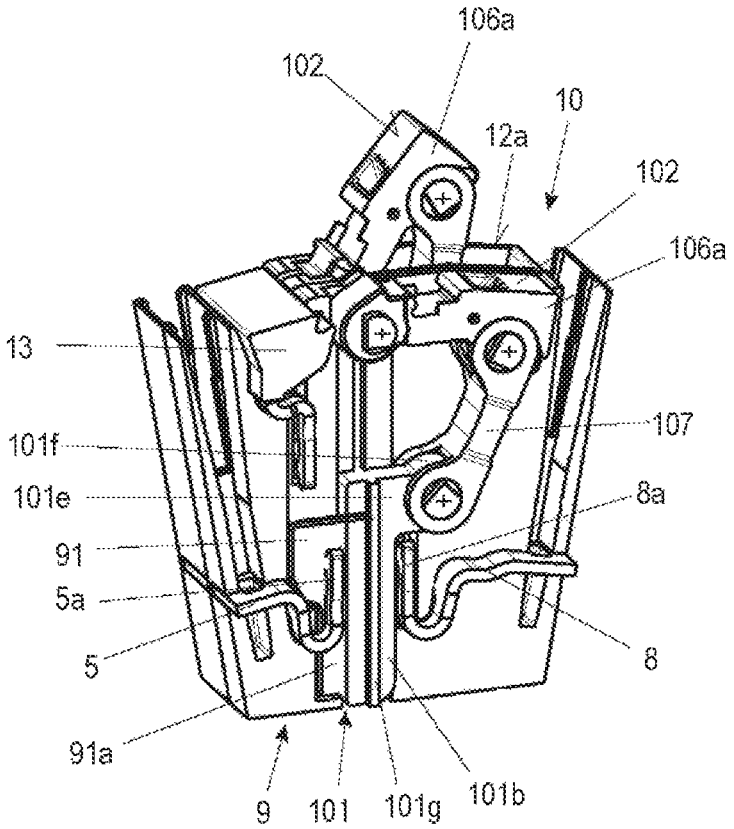
Figure 13:
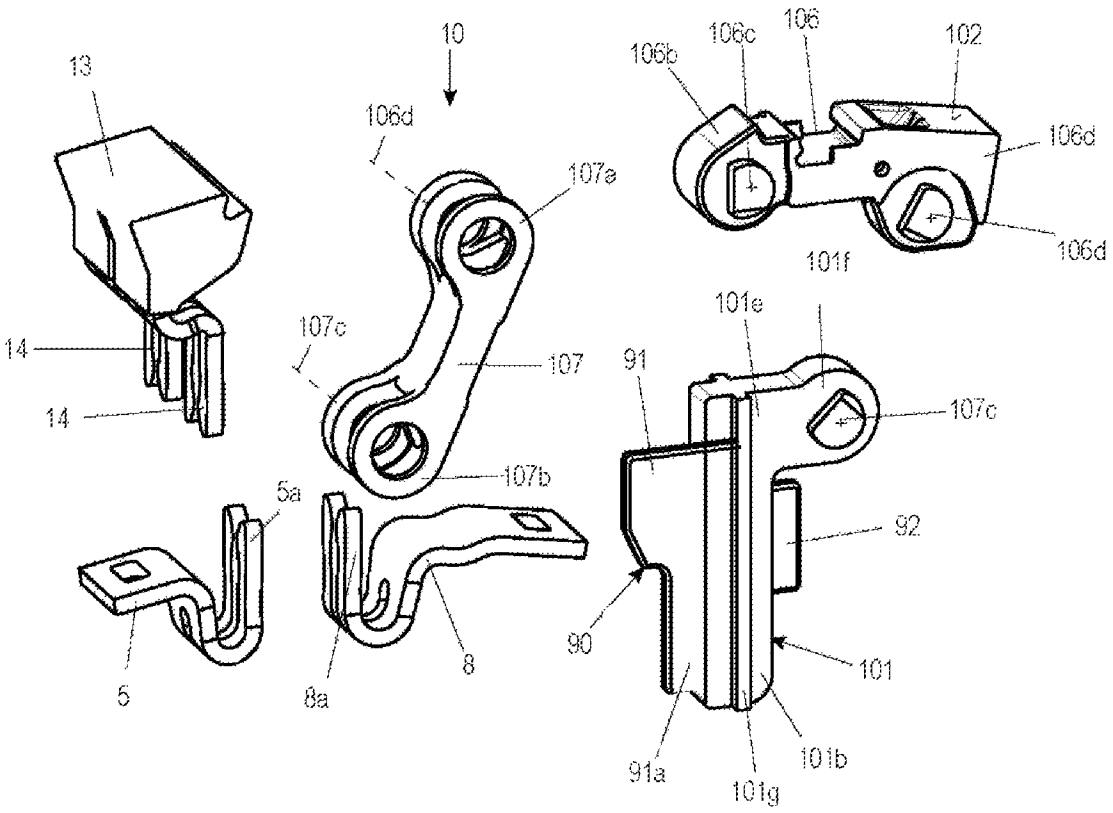
FIGS. 13 and 14 are exploded perspective views of individual components of the actuation device and the switching device of the third embodiment according to FIGS. 10*a*-10*c*, respectively.
Figure 14:
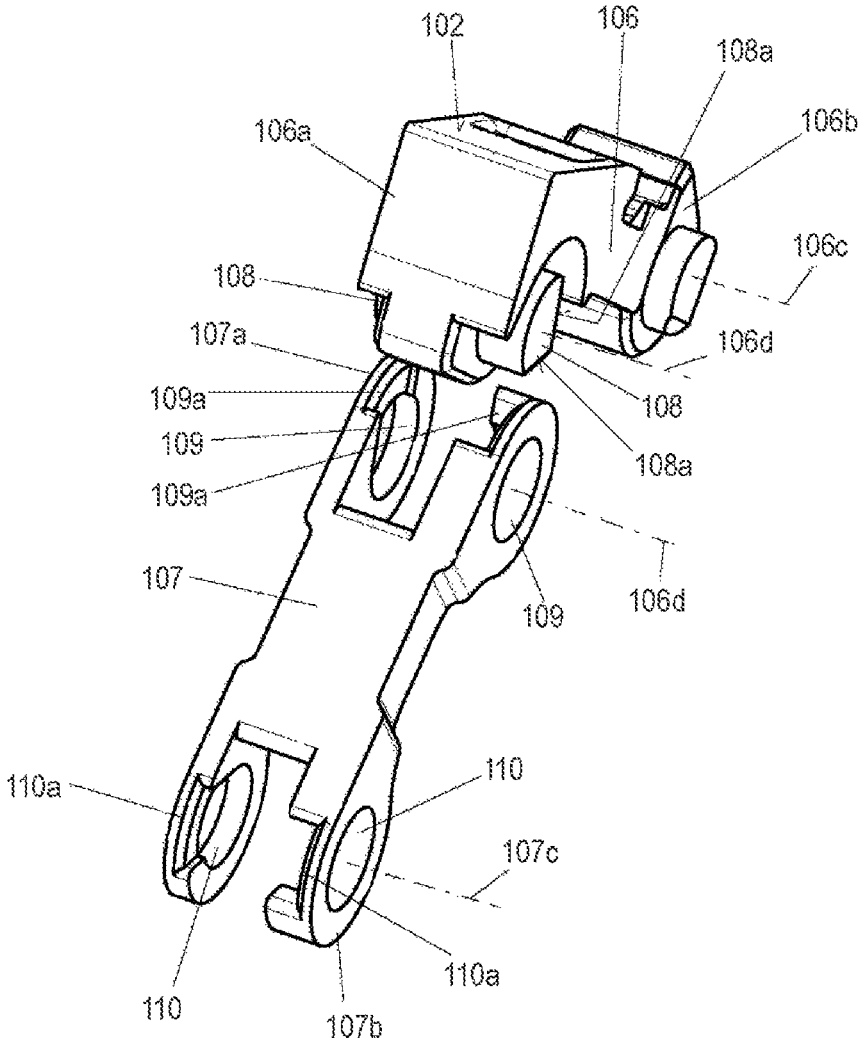

FIGS. 10*a*-10*c* are perspective views of a third embodiment of the disconnect unit 11 of the disconnect terminal 1 according to FIG. 1, in various positions. FIGS. 11*a*-11*c* are perspective views of the actuation device 10 and the switching device 9 of the second embodiment according to FIG. 10*a*-10*c* in various positions without an enclosure. FIGS. 12*a*-12*c* are perspective views of the actuation device 10 and the switching device 9 according to FIGS. 11*a*-11*c* in various positions with an enclosure. FIG. 13 is an exploded perspective view of individual components of the actuation device 10 and the switching device 9 of the third embodiment according to FIGS. 10*a*-10*c*. FIG. 14 is an exploded perspective view of components of a lever gear mechanism.

FIG. 10*a*, FIG. 11*a*, and FIG. 12*a* show the connecting position of the disconnect units 11. The disconnecting position of the disconnect units 11 is respectively shown in FIG. 10*b*, FIG. 11*b*, and FIG. 12*b*, FIG. 10*c*, FIG. 11*c*, and FIG. 12*c* each show a disconnect unit 11 of the two disconnect terminals 1 in a disconnecting position, and they each show a disconnect unit 11 in a connecting position. It is clearly shown which disconnect terminal is set to a disconnecting position and which is set to a connecting position.

Also in the third embodiment, the switching device 9 and the actuation device 10 are separated. The switching device 9 includes the linearly movable sliding element 101 with the switching end 101*b* and the upper end portion 101*e*. The contact plate 90 with the contact portions 91, 91*a*, and 92 is provided as in the first and second embodiments. The disconnect unit 11 features the bridge contact forks 14 with the bridge holder 13 as described above As in the second embodiment, the sliding element 101 of the third embodiment features the end portion 101*e* without an actuation portion and without a visible portion.

Contrary to on the second embodiment, the end portion 101*e* is laterally broadened by a wedge-shaped connecting portion 101*f*.

On the two longitudinal sides of the sliding element 101 pointing outward towards the wall 15, longitudinally extending guide portions 101*g* are fitted along the entire length of the sliding element 101 by which the sliding element 101 is linearly movably guided in the walls 15.

Contrary to the second embodiment, the actuation device 10 includes a lever gear mechanism with an actuation lever 106 and a transmission lever 107.

The actuation lever 106 features an actuation end 106*a* with the visible portion 102, and a bearing end 106*b*. With the bearing end 106*b*, the actuation lever 106 is attached in a pivotable manner to an unmarked body of the disconnect unit 11 by means of a joint axis 106*c*. The bearing end 106*b* is arranged above the end portion 101*e* of the sliding element 101, wherein the joint axis 106*c* aligns with a longitudinal axis of the sliding element 101.

The actuation end 106*a* of the actuation lever 106 is pivotably connected with a drive end 107*a* of the transmission lever 107 by a joint axis 106*d*. The transmission lever 107 extends from the actuation lever 106 downward to the wedge-shaped connecting portion 101*f* of the sliding element 101 and is pivotably coupled with this connecting portion 101*f* via an output end 107*b* around an output joint axis 107*c*.

In the connecting position, both the visible portion 102 of the actuation portion 105*a* of the actuation lever 105*a* and the largest part of the surface of the actuation lever 105 align with the surface(s) 12*a* of the walls 15 of the disconnect unit 11. The walls 15 may be part of the enclosure 2. The transmission lever 106 abuts a system portion 15*d* of the disconnect unit 11 with its lower side by way of a limit stop.

The connecting position of the sliding element 101 with the contact plate 90 is as described for the first embodiment.

It is pivoted around the fixed joint axis 106*c* (in this case in a counterclockwise direction) by a pivoting actuation of the actuation portion 106*a* of the actuation lever 106. The transmission lever 107 is pulled upward and it simultaneously pulls the sliding element 101 upward from the connecting position into the disconnecting position. As described above with respect to the first embodiment, the electro-conductive connection between the contact forks 5*a* and 8*a* is thereby separated.

In the disconnecting position, the actuation lever 106 is pivoted upward around the fixed joint axis 106*c* so that the actuation end 106*a* and the visible portion 102 of the surface 12 of the disconnect unit 11 or of the disconnect portion 2*c* or of the bridge holder 13 protrude in a clearly visible manner.

The sliding path of the sliding element 101 is realized in the disconnecting position by a limit stop of the end portion 101*e* at the lower side of the bearing end 106*b* of the actuation lever 106.

An assembly of the lever gear mechanism in the respective axes 106*c*, 106*d*, 107*c* with the actuation lever 106 and the transmission lever 107 is shown in FIG. 14. In the axes 106*c* and 106*d*, the actuation lever 106 features laterally protruding joint pins 108. The joint pins 108 feature lateral flat surfaces 108*a* that can be easily inserted into corresponding recesses of respective, joint bores 109 on the drive end 107*a* of the transmission lever 107 on both sides. By turning the levers 106, 107 towards each other, an articulated connection is possible. This is shown for the joint axis 106*d*. The other joints are formed in a similar manner. Thus, the output end 107*b* features joint bores 110 with a recess 110*a*. With respect to the fixed bearing end 106*b*, corresponding walls 15 are formed.

Figure 15A:
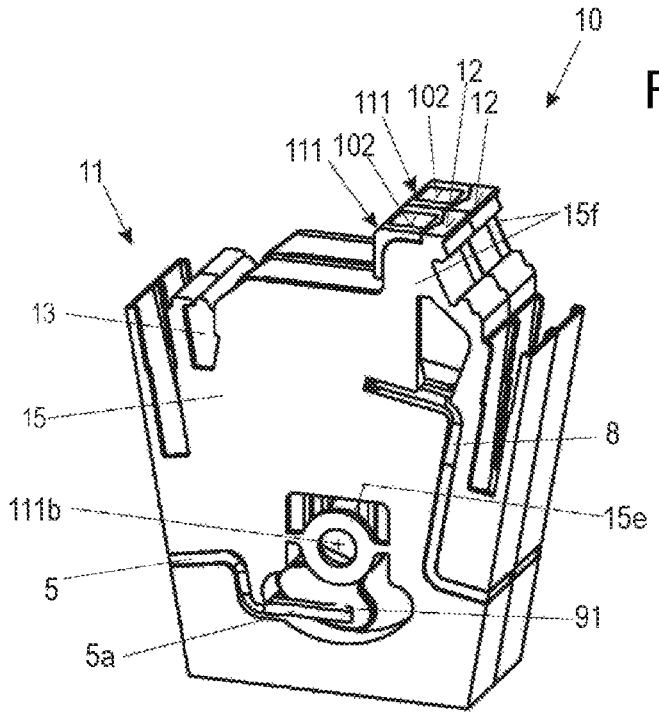
FIGS. 15*a*-15*c* are perspective views of a fourth embodiment of a disconnect unit of the disconnect terminal according to FIG. 1, in various positions, respectively.
Figure 15B:
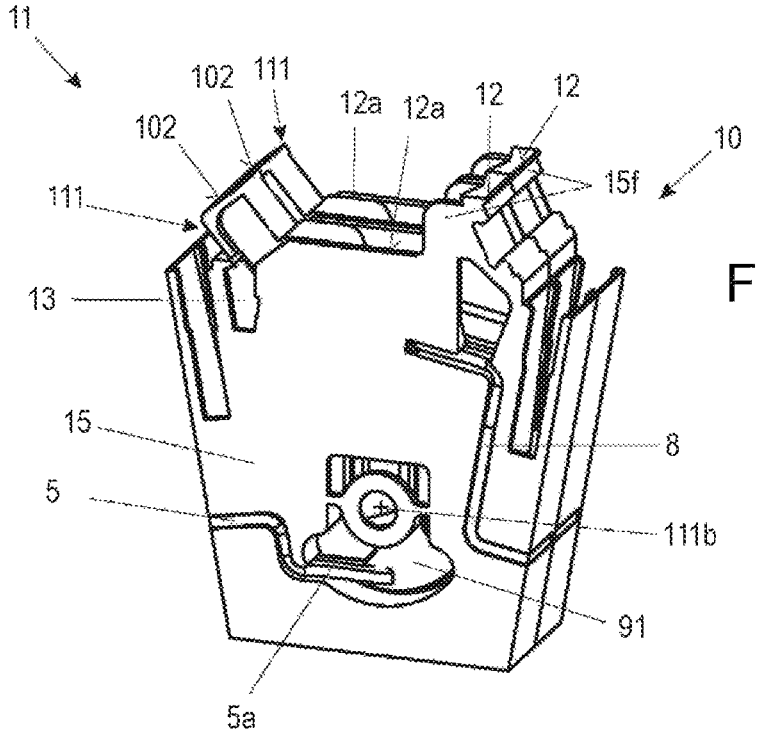
Figure 15C:
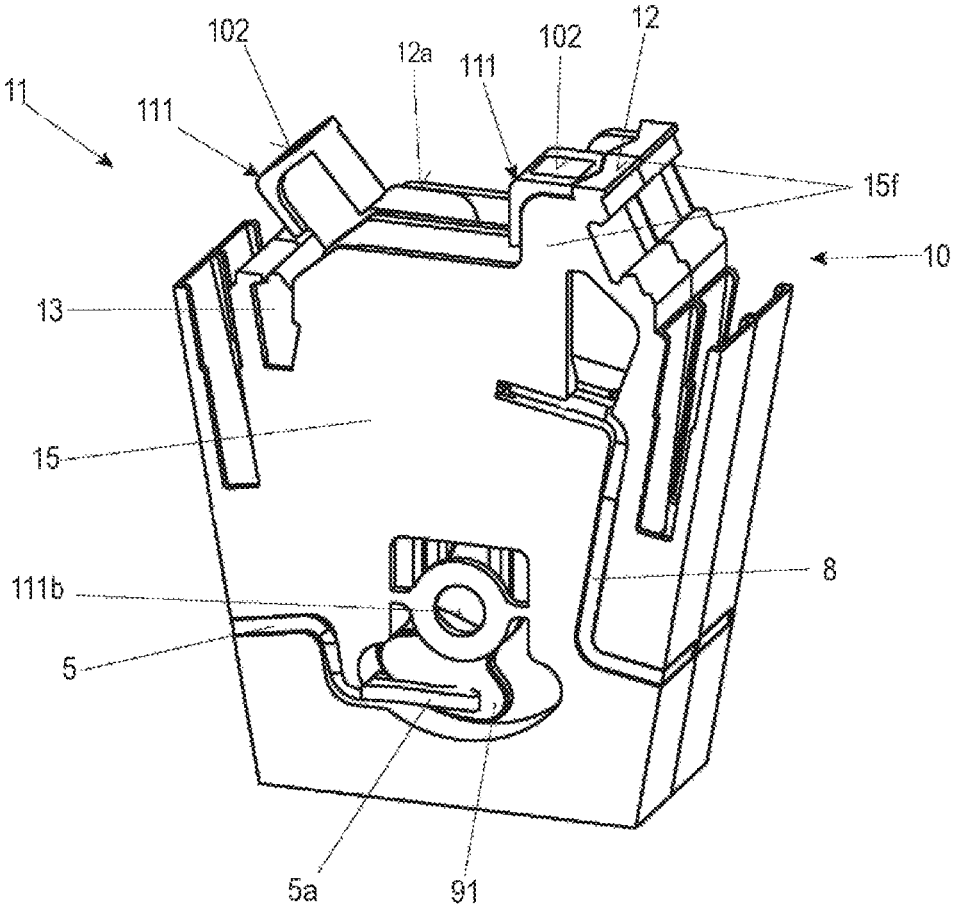
Figure 16B:
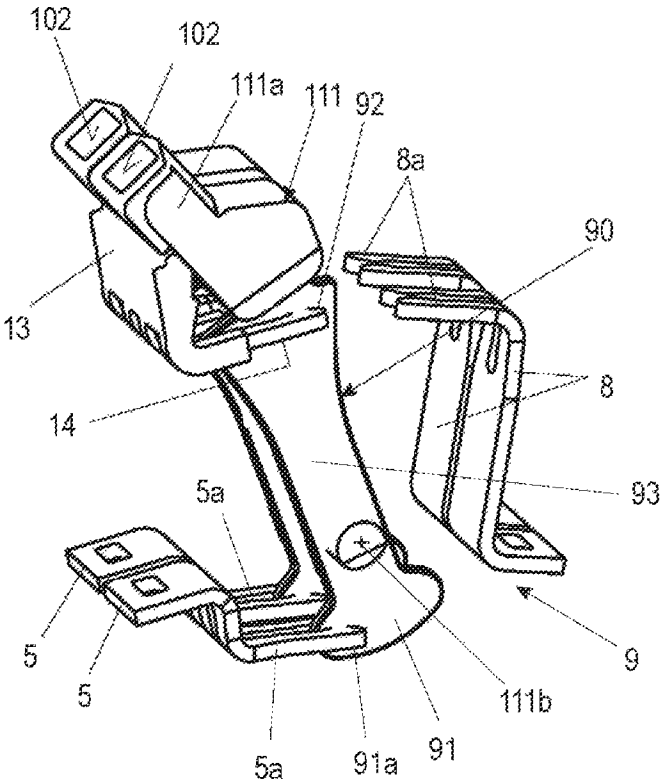
FIGS. 16*a*-16*c* are perspective views of the actuation device and the switching device of the fourth embodiment according to FIGS. 15*a*-15*c*, respectively, in various positions without an enclosure.
Figure 16A:
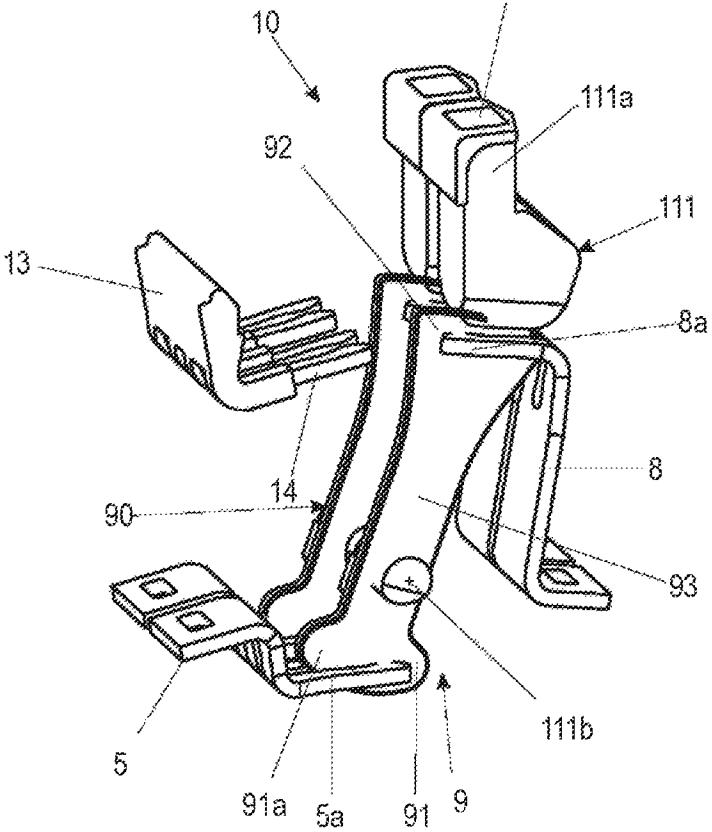
Figure 16C:
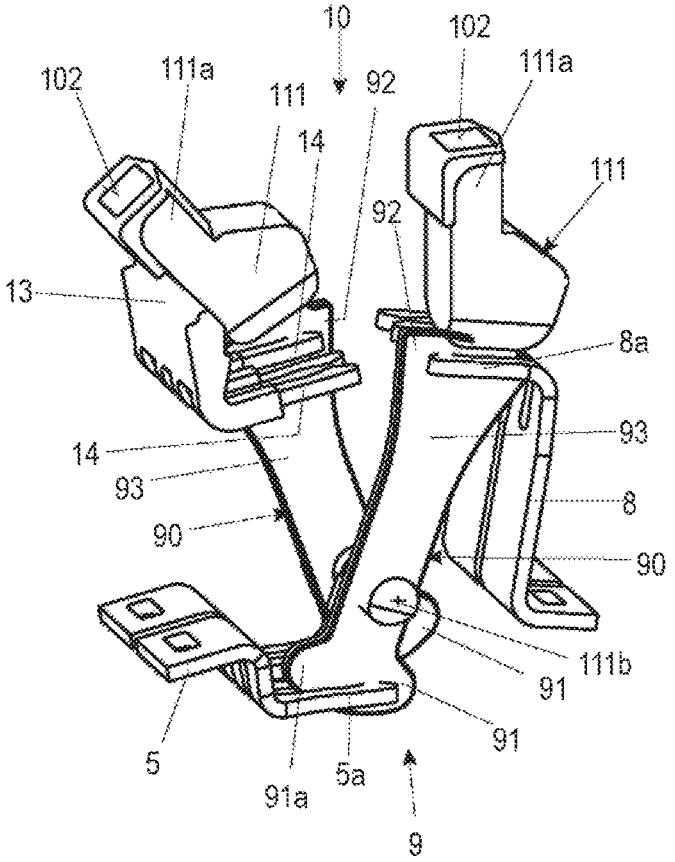
Figure 17B:
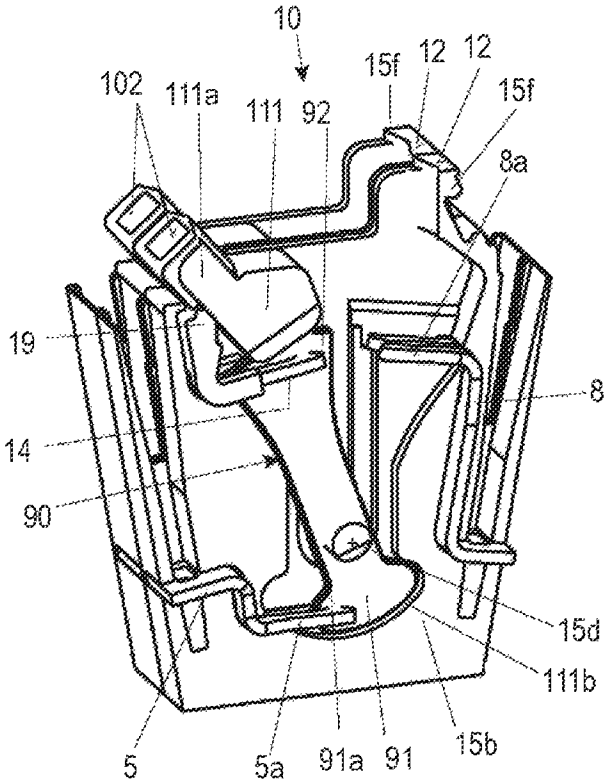
FIGS. 17*a*-17*c* are perspective views of the actuation device and the switching device of the fourth embodiment according to FIGS. 16*a*-16*c*, respectively, in various positions with an enclosure.
Figure 17A:
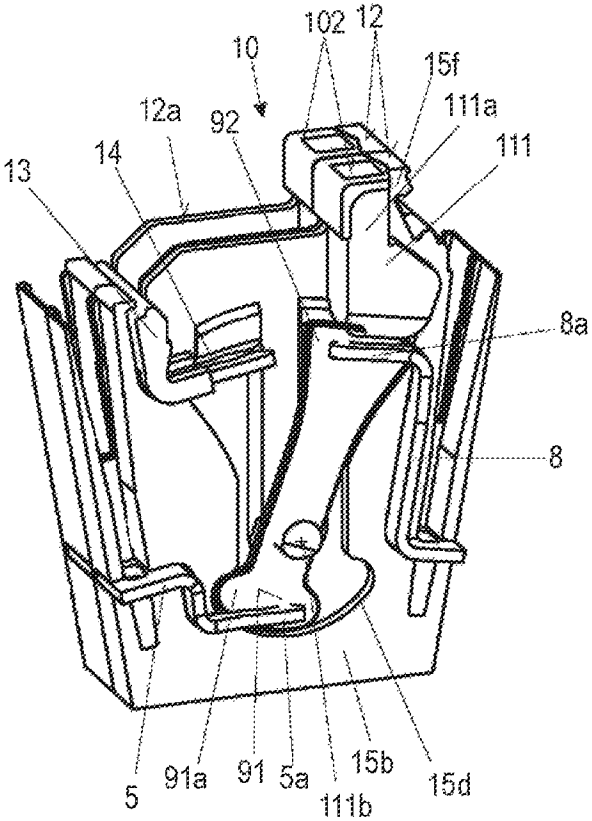
Figure 17C:
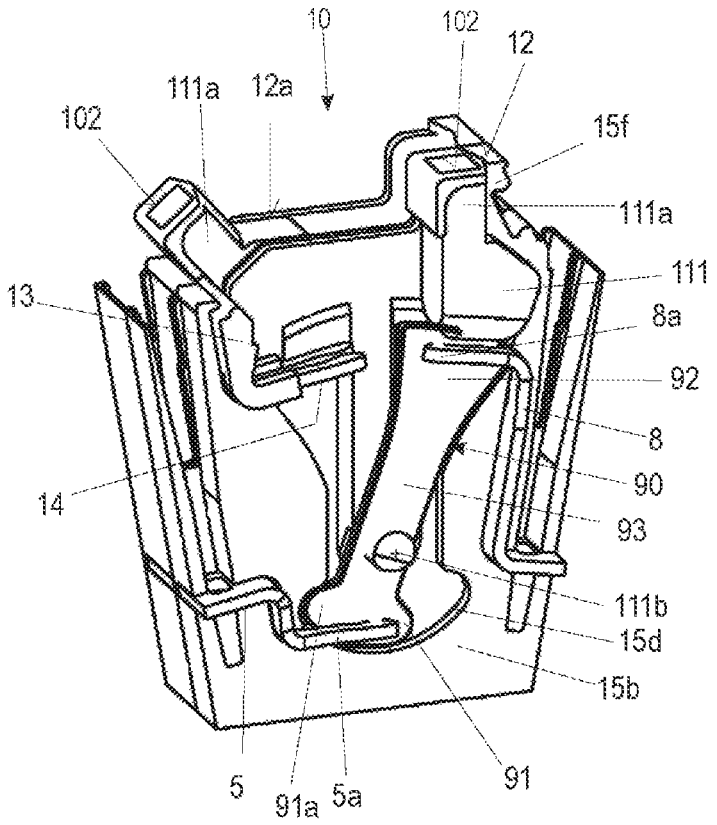
Figure 18:
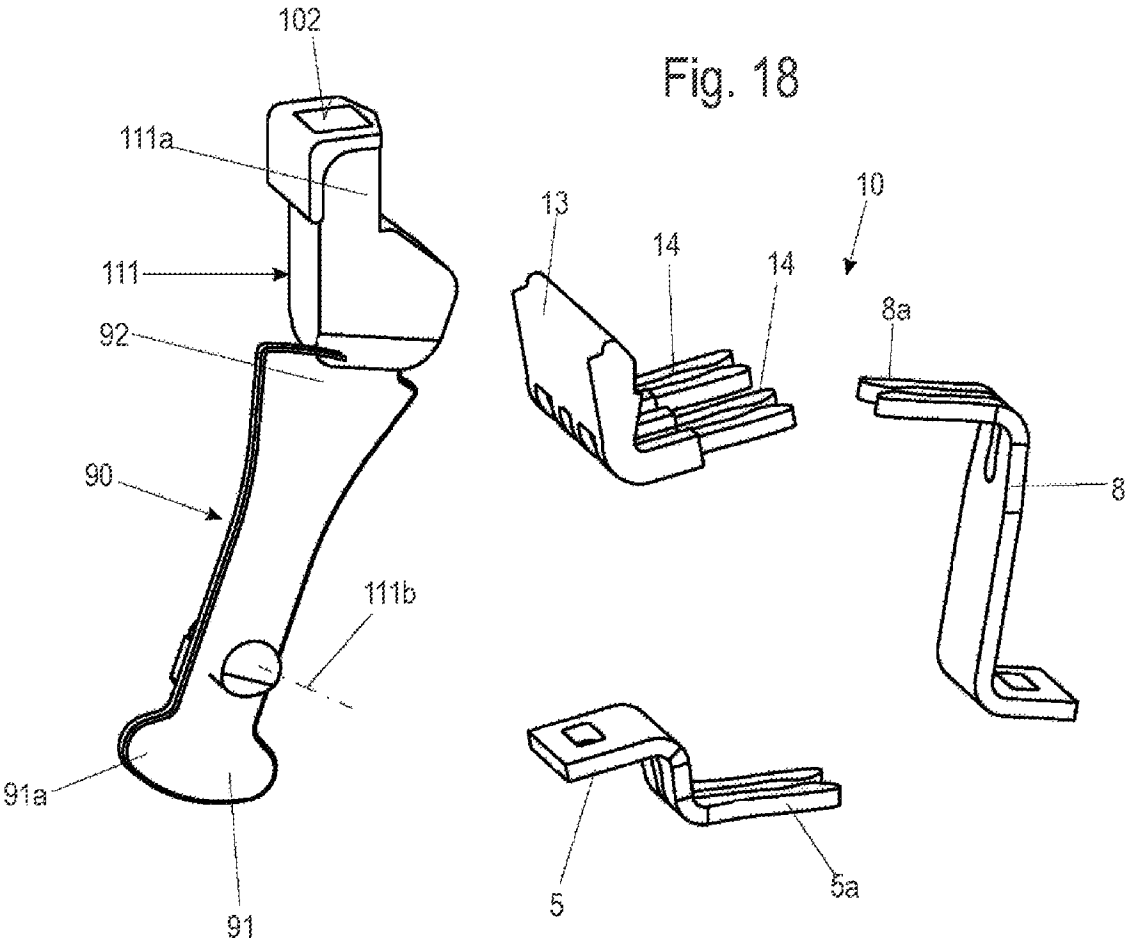
FIG. 18 is an exploded perspective view of individual components of the actuation device and the switching device of the fourth exemplary embodiment according to FIGS. 15*a*-15*e;*
Figure 19B:
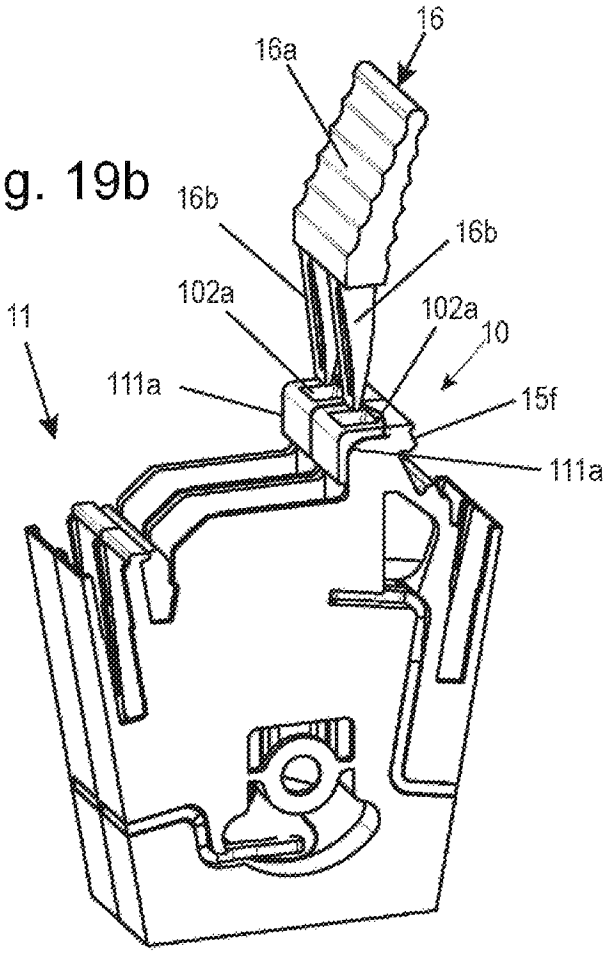
FIGS. 19*a* and 19*b* are perspective views of the disconnect unit of the fourth exemplary embodiment according to FIGS. 15*a*-15*c* with an actuating element.
Figure 19A:
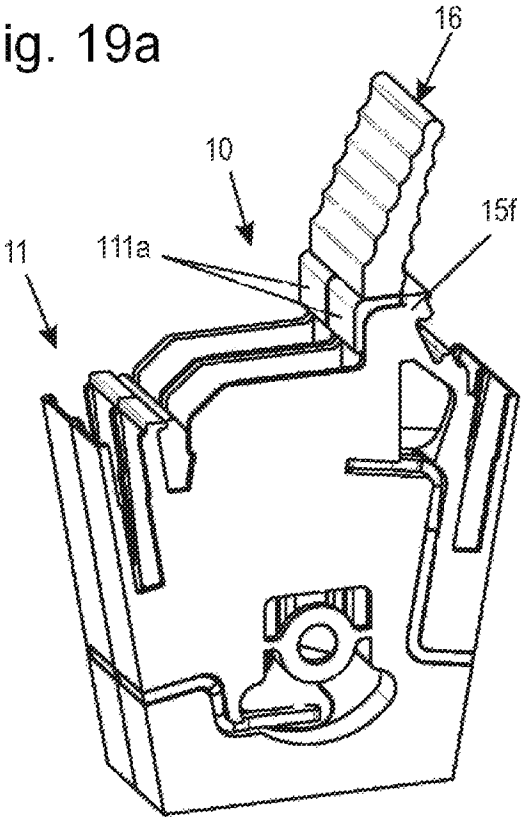

FIGS. 15*a*-15*c* are perspective views of a fourth embodiment of the disconnect unit 11 of the disconnect terminal 1 according to FIG. 1, in various positions. FIGS. 16*a*-16*c* are perspective views of the actuation device 10 and the switching device 9 of the fourth embodiment according to FIGS. 15*a*-15*c* in various positions without an enclosure. FIGS. 17*a*-17*c* are perspective views of the actuation device 10 and the switching device 9 according to FIGS. 16*a*-16*c* in various positions with an enclosure. FIG. 18 is an exploded perspective view of individual components of the actuation device 10 and the switching device 9 of the fourth embodiment according to FIGS. 15*a*-15*c*.

FIG. 15*a*, FIG. 16*a*, and FIG. 17*a* show the connecting position of the disconnect units 11. The disconnecting position of the disconnect units 11 is shown in FIG. 15*b*, FIG. 16*b*, and FIG. 17*b*. FIG. 15*c*, FIGS. 16*c*, and 17*c* each show a disconnect unit 11 of the two disconnect terminals 1 in a disconnecting position, and they each show a disconnect unit 11 in a connecting position. It is clearly shown which disconnect terminal is set to a disconnecting position, and which is set to a connecting position.

Contrary to the previous embodiments, the contact fork 8*a* of the second conductor rail 7 is not arranged opposite the contact fork 5*a* of the first conductor rail but it is bent upward, in other words, arranged upward at a distance.

Furthermore, the bridge contact forks or prongs 14 are arranged opposite the contact forks 8*a* and bent towards them.

In the fourth embodiment, the switching device 9 and the actuation device 10 are formed jointly as in the first embodiment.

The switching device 9 features the contact plate 90 in an elongated blade-like form. The contact plate 90 is formed entirely of an electrically conductive contact material and includes the contact portions 91, 91*a*, and 92 as well as an electrically conductive connecting portion 93.

At the lower end of the contact plate 90, the contact portion 91*a* is fitted on the side pointing to the contact fork 5*a*. The contact portion 91 is fitted across from it on the other side.

The contact portions 91, 91*a* interact with the contact fork 5*a*.

The contact portion 92 is fitted on the upper end of the contact plate 90 on both sides as are the portions 91 and 91*a*.

The contact portions 91, 91*a*, and 92 are electrically connected via the connecting portion 93.

The contact plate 90 is arranged in its lower part in a fixed connection in a bearing portion 15*e* between the walls 15 in the disconnect unit 11 and pivotable around a pivoting axis 111*b*.

The upper end of the contact plate 90 is solidly connected with the actuation device 10.

The actuation device 10 features a switch lever 111 with an actuation end 111*a*. The visible portion 102 is arranged on the actuation end 111*a*.

In the connecting position, the actuation end 111 of the switch lever 111 is essentially vertical and abuts the enclosure stop 15*f*. The visible portion 102 aligns with the surface 12 of the enclosure stop 15*f*. The enclosure stop 15*f* is a portion of the enclosure 2.

In the connecting position, the right-side area of the contact portion 92 of the contact plate 90 is in contact with the contact fork 8*a*. The contact portion 91 of the contact plate 90 is in contact with the contact fork 5*a*. In the connecting position, this creates an electrical connection between the contact fork 5*a*, the contact portion 91, the connecting portion 93, the contact portion 92, and the contact fork 8*a*.

The contact plate 90 is pivoted (here in a counterclockwise direction) around the fixed pivoting axis 111*b* by a pivoting actuation of the actuation portion 111*a* of the switch lever 111. The contact portion 92 switches from the contact fork 8*a* to the bridge contact fork 14. The contact portion 91 leaves the contact fork 5*a*, but the contact portion 91*a* connected with it remains in contact with the contact fork 5*a* by way of a drag contact.

In the disconnecting position, the switch lever 111 with the contact plate 90 is pivoted to the left around the fixed pivoting axis 111*b*, the actuation end 111*a* abutting the limit stop at the bridge holder 13. The visible portion 102 protrudes from the surface 12*a* of a portion of the enclosure 2. The portion of the enclosure 2 may be the upper side of the wall 15 of the enclosure 2. Furthermore, the portion of the enclosure 2 is also the upper side of the bridge holder 13 on which the surface 12 is arranged.

In the disconnecting position, this creates a disconnect between the contact forks 5*a* and 8*a*, in other words, between the first conductor rail 4 and the second conductor rail 7. At the same time, the contact fork 5*a* of the first conductor rail 4 and the bridge contact fork 14 are electrically connected via the contact plate 90.

The actuation end 111*a* of the switch lever 111 can be shifted manually, by a tool, or by an actuating element 16. This is shown by the actuating element 16 in perspective views of the disconnect unit 11 of the fourth embodiment according to FIGS. 15*a*-15*e* and FIGS. 19*a* and 19*b*.

The actuating element 16 features a body 16*a* for manual actuation as well as an insertion portion 16*b* with which the actuating element 16 can be inserted into the actuation end 111*a* that features a recess for that purpose. The actuating element 16 may feature one, two, or multiple insertion portions 16*b*. The actuating element 16 allows for the synchronous actuation of two or more sectioning points.

Figure 20:
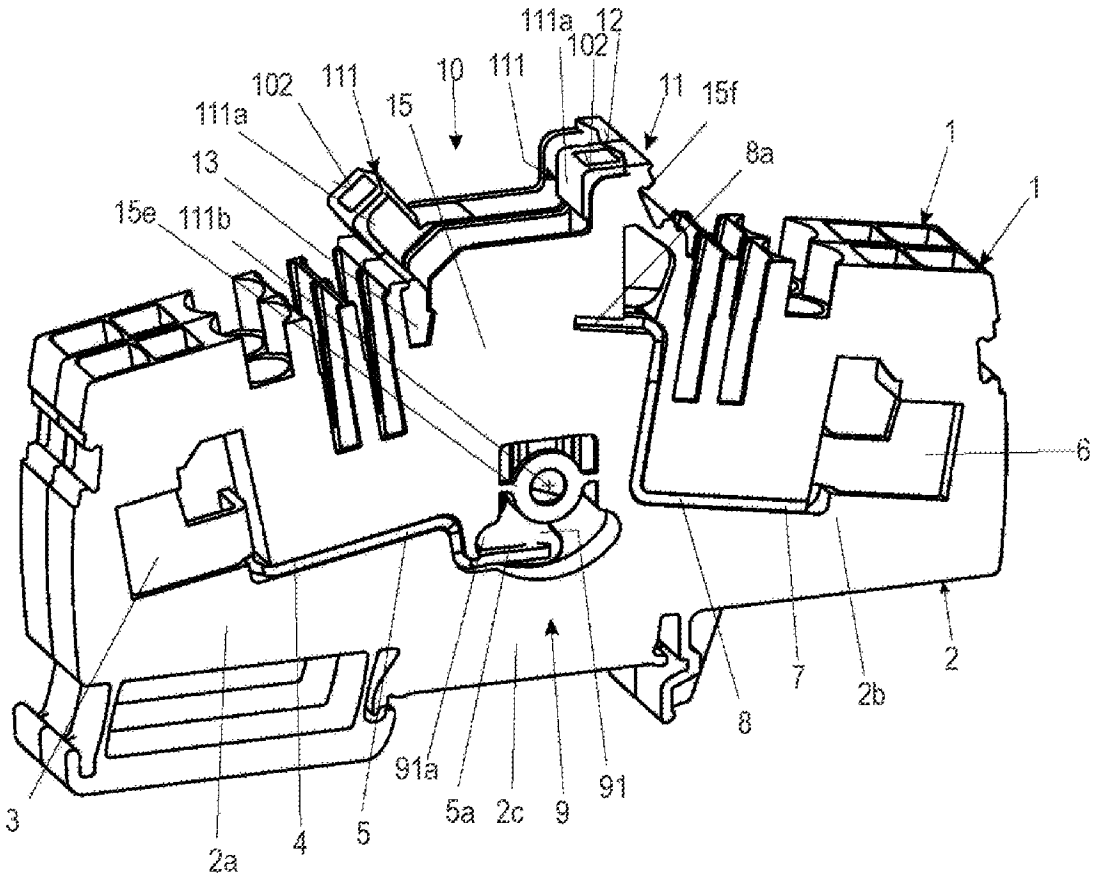
FIG. 20 is a perspective view of the disconnect terminal according to the invention with the fourth exemplary embodiment of the disconnect unit according to FIGS. 15*a*-15*c*.

FIG. 20 is a perspective view of the disconnect terminal 1 according to the invention in a doubly lined-up assembly with the fourth embodiment of the disconnect unit 11 according to FIGS. 15*a*-15*c*.

Figure 21B:
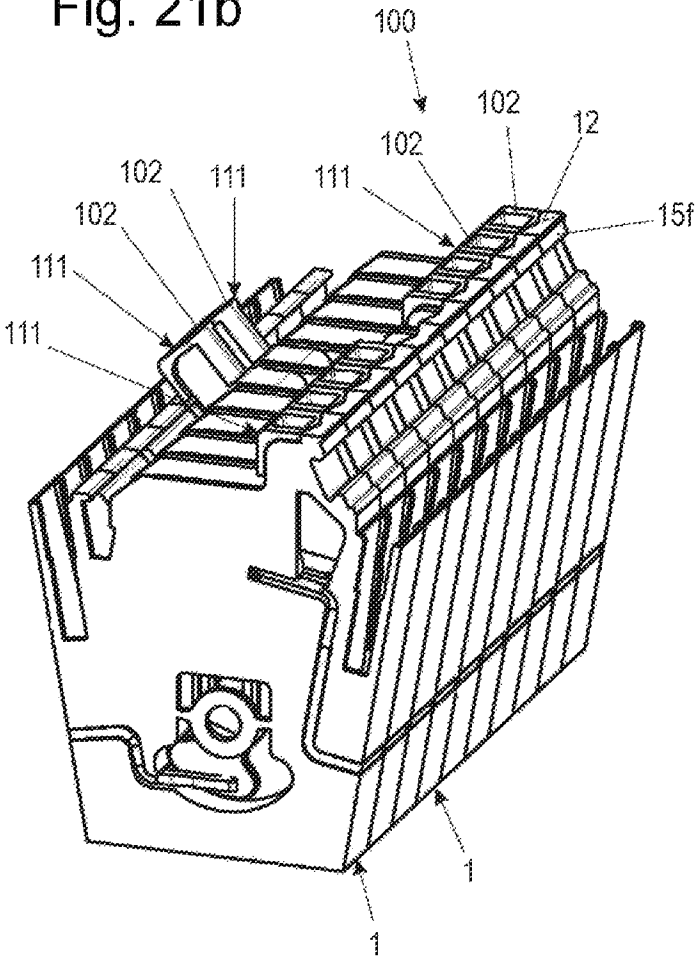
FIGS. 21*a* and 21*b* are perspective views of assemblies of disconnect terminals according to the invention with the fourth exemplary embodiment of the disconnect unit according to FIGS. 15-15*b*.
Figure 21A:
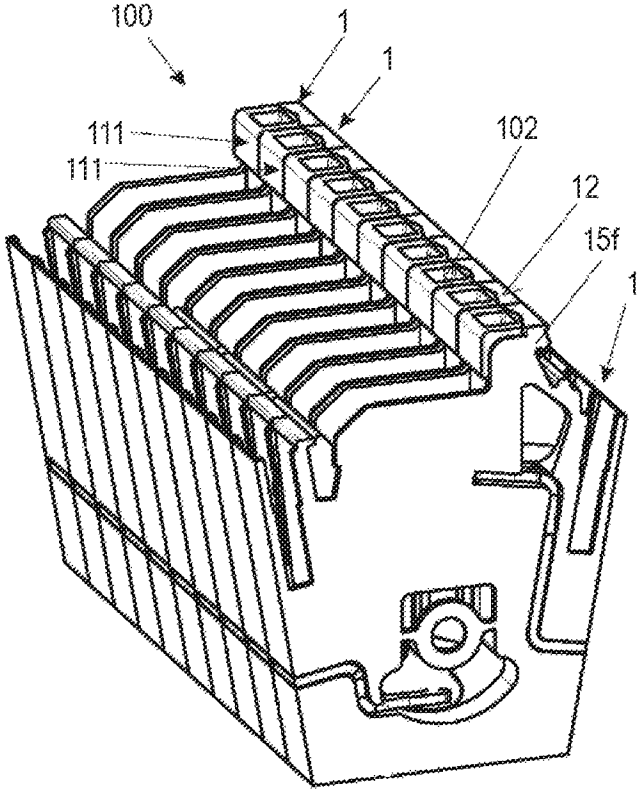

Schematic perspective views of assemblies 100 of disconnect terminals 1 according to the invention of the fourth embodiment of the disconnect unit 11 according to FIGS. 15*a*-15*c* are shown in FIGS. 21*a* and 21*b* in aligned assemblies 100.

It is clearly visible which disconnect terminals 1 are in the disconnecting position and which are in the connecting position, since in the disconnecting position, the respective actuation ends of the switch levers 111 protrude with their visible portions 102 from the surface 12, 12*a* of the enclosure 2 and of the bridge support 13 of the disconnect units 11 wherein they no longer abut the enclosure stops 15*f*.

The invention claimed is:

1. A disconnect terminal, comprising (a) a housing;

(b) first and second conductor rails arranged on said housing;

(c) a switching device arranged between said first and second conductor rails and operable between a connecting position wherein said first and second conductor rails are electrically connected and a disconnecting position wherein said first and second conductor rails are electrically disconnected, said switching device including a contact plate formed of an electrically conductive material and having a plurality of contact portions, at least one of said contact portions comprising a drag contact, said contact plate electrically connecting said first and second conductor rails via a bridge contact and said drag contact when said switching device is in said connecting position; and (d) an actuation device arranged in said housing for operating said switching device between said connecting and disconnecting positions, said actuating device including a visible portion aligned with an upper surface of said housing, said visible portion protruding from said housing when said switching device is in said disconnecting position.

2. The disconnect terminal as defined in claim 1, wherein said switching device and said actuation device include a joint linearly movable sliding element connected with said contact plate.

3. The disconnect terminal as defined in claim 2, wherein said sliding element includes a guide portion configured as a bridge having a front surface and which includes said visible portion.

4. The disconnect terminal as defined in claim 2, wherein said sliding element includes an actuation portion which includes said visible portion.

5. The disconnect terminal as defined in claim 4, wherein said housing includes an inner body member including a guide portion and limit stops, and further comprising a limiting slider and a gear for coupling said sliding element with said limiting slider, said limiting slider defining an adjustment track of said sliding element which interacts with said limit stops of said inner body member.

6. The disconnect terminal as defined in claim 1, wherein said switching device includes a linearly movable sliding element which includes said contact plate, and further wherein said actuation device includes an actuating element coupled with said sliding element via interlocking gears.

7. The disconnect terminal as defined in claim 6, wherein said actuating element includes an actuation portion including said visible portion, said actuating element being pivotally connected with said housing.

8. The disconnect terminal as defined in claim 1, wherein said switching device includes a linearly movable sliding element which includes said contact plate, and further wherein said actuation device includes an actuation lever including said visible portion and coupled with said sliding element via a lever gear mechanism.

9. The disconnect terminal as defined in claim 8, wherein said lever gear mechanism includes said actuation lever and a transmission lever coupled with said sliding element.

10. The disconnect terminal as defined in claim 1, wherein said switching device includes a switch lever having an actuation end which includes said visible portion, said switching device being formed by said contact plate which is configured as an elongated blade.

11. The disconnect terminal as defined in claim 10, wherein said switch lever of said actuation device is connected with said contact plate and is pivotable with said contact plate around a joint fixed switch lever pivot axis.

12. The disconnect terminal as defined in claim 11, wherein when said switching device is in said connecting position, said switch lever abuts a housing stop with its actuation end and said visible portion aligns with a surface of said housing stop, and when said switching device is in said disconnecting position, said switch lever with said contact plate is pivoted around said fixed switch lever pivot axis and abuts a bridge holder via a limit stop, said visible portion of said actuation ends of said switch lever protruding from the surface of a bridge holder portion of said housing.

13. An assembly of at least two aligned disconnect terminals as defined in claim 1.

14. An assembly as defined in claim 13, wherein said at least two disconnection terminals include a bridge holder having bridge contacts electrically connected with each other.

15. An assembly of at least two disconnect terminals, each of which comprises (a) a housing;

(b) first and second conductor rails arranged on said housing;

(c) a switching device arranged between said first and second conductor rails and operable between a connecting position wherein said first and second conductor rails are electrically connected and a disconnecting position wherein said first and second conductor rails are electrically disconnected, said switching device including a contact plate formed of an electrically conductive material and having a plurality of contact portions, at least one of said contact portions comprising a drag contact, said contact plate electrically connecting said first and second conductor rails via a bridge contact and said drag contact when said switching device is in said connecting position;

(d) an actuation device arranged in said housing for operating said switching B device between said connecting and disconnecting positions, said actuating device including a visible portion aligned with an upper surface of said housing, said visible portion protruding from said housing when said switching device is in said disconnecting position; and (e) a joint sliding element connected with said switching device and said actuation device linearly movable within said housing, said joint sliding elements of said disconnect terminals being connected by detachable actuating elements for synchronous actuation of the terminals.

* * * * *